US006666666B1

(12) United States Patent
Gilbert et al.

(10) Patent No.: US 6,666,666 B1
(45) Date of Patent: Dec. 23, 2003

(54) MULTI-CHAMBER POSITIVE DISPLACEMENT FLUID DEVICE

(76) Inventors: Denis Gilbert, 167 Woodside Rd., Airdrie, Alberta (CA), T4B 2E2; Arnoud Struyk, 221 Woodbriar Cir. S.W., Calgary, Alberta (CA), T2W 6B3

( * ) Notice: Subject to any disclaimer, the term of this patent is extended or adjusted under 35 U.S.C. 154(b) by 0 days.

(21) Appl. No.: 10/155,083

(22) Filed: May 28, 2002

(51) Int. Cl.[7] ..... F03C 2/00

(52) U.S. Cl. ..... 418/9; 418/200; 418/152; 418/1

(58) Field of Search ..... 418/9, 1, 152, 418/200

(56) References Cited

U.S. PATENT DOCUMENTS

| | | | | | |
|---|---|---|---|---|---|
| 1,430,894 | A | * | 10/1922 | Fay | 418/200 |
| 2,096,490 | A | | 10/1937 | Hansen | |
| 2,193,273 | A | | 3/1940 | Dietzel | |
| 2,247,454 | A | | 7/1941 | Thomson | |
| 2,279,136 | A | | 4/1942 | Funk | |
| 2,633,807 | A | | 4/1953 | Collura | |
| 2,642,808 | A | | 6/1953 | Thomas | |
| 2,672,823 | A | | 3/1954 | Thomson et al. | |
| 2,750,891 | A | * | 6/1956 | Berry | 418/200 |
| 2,975,963 | A | * | 3/1961 | Nilsson | 418/200 |
| 4,293,290 | A | * | 10/1981 | Swanson | 418/206.7 |
| 6,095,781 | A | | 8/2000 | Petersen et al. | |
| 6,210,138 | B1 | | 4/2001 | Cortez | |
| 6,270,324 | B1 | | 8/2001 | Sullivan et al. | |

FOREIGN PATENT DOCUMENTS

| | | | | |
|---|---|---|---|---|
| JP | 59087293 A | * | 5/1984 | F04C/23/02 |
| JP | 04353284 A | * | 12/1992 | F04C/11/00 |

OTHER PUBLICATIONS

Pump School, Internet website, Pump School's Rotary Pump Family Tree, http://www.pumpschool.com/intro/pdtree.htm, Apr. 8, 2002, 4pp.

Pump School, Internet website, Lobe Pumps, http://www.pumpschool.com/principles/lobe.htm, Feb. 7, 2002, 4pp.

Pomac, Internet website, lobe pumps, http://www.pomac.nl/pumps/lobe_lprp.htm , Apr. 8, 2002, 2pp.

Waukesha Cherry–Burrell, Internet website, Products: Universal II Pump, http://www.waukesha–cb.com/products/pumps/univ2.htm , Apr. 10, 2002, 2pp.

Christopher Gultch, Waukesha Pumps Universal II Series—Manual, Oct. 4, 2001, 53 pp.

Tuthill Pump Group, HD Series Pumps Standard Duty Models, Installation and Service Instructions, Service manual #72, 2pp only (cover and p. 5—exploded view of pump).

* cited by examiner

*Primary Examiner*—Thomas Denion
*Assistant Examiner*—Theresa Trieu
(74) *Attorney, Agent, or Firm*—Sean W. Goodwin

(57) ABSTRACT

A pump comprises multiple, axially stacked positive displacement fluid device sections, such as circumferential piston pumps having chambers and contra-rotating chambers. The device can be similarly employed as a fluid motor. The stacked sections are arranged within an outer retaining barrel in one or more stages. The pump is particularly suitable for installation downhole in the casing of a wellbore. Each section comprises a pair of rotors fit to shafts which are rotatably supported on hard faced bearings between the shafts and the bosses. Each pump section draws fluid from an inlet port and discharges fluid to a common and contiguous discharge manifold. The inlets of the pump sections for a suction stage communicate with a fluid source. Cross-over sections route fluid between stages. Successive pressure stages draw fluid from the cross-over fit to the preceding stage's discharge manifold.

23 Claims, 17 Drawing Sheets

MULTI-CHAMBER POSITIVE DISPLACEMENT FLUID DEVICE

FIELD OF THE INVENTION

This invention relates to positive displacement fluid devices such as fluid-driven motors and pumps which are operable for pumping high temperature, and contaminated fluids. More particularly, such a fluid device is a circumferential piston pump or motor configured for multi-chambered use in stacked and multi-stage operation.

BACKGROUND OF THE INVENTION

Conventional methods and apparatus for bringing well fluids to the surface involve various pump systems of different designs and methods of operation. Restrictions on existing pump systems sometimes include dimensional constraints, the ability to handle high temperature and the need to pump contaminated fluids, e.g. high sand content particularly at high temperature. Conventional pumps are limited by their use at high temperature and with contaminant sensitive polymers.

Further, pumps having rotating components must have some form of bearing to separate the moving from the stationary components. It is a constant challenge to maintain bearing integrity in high temperature or contaminated environments. Such environments include those typical in the recovery of high temperature hydrocarbons from Steam Assisted Gravity Drainage (SAGD) wells in the heavy oil and bitumen recovery of northern Alberta, Canada.

In downhole operations, such as conventional oil recovery operations, progressive cavity (PCP) pumps have been applied to great effectiveness. However, as the well becomes deeper, as the temperature increases, and as the level of contamination increases, the elastomers used begin to fail resulting in pump failure and more frequent and expensive turnovers.

As an alternative, one may consider positive displacement pumps which are applied in food and other fluid industries. Among this class of pumps are circumferential piston pumps which have been known since at least 1935 in U.S. Pat. No. 2,096,490 to Hanson and still in production today by Waukesha Delavan, Wis. (Universal II Series) and Tuthill of Alsip, Ill. (HD Series). Conventional circumferential piston pumps utilize opposing, contra-rotating rotors having pistons which are alternately swept through a common chamber. Timing gears coordinate the rotor rotation. Traditionally used in surface applications, significant effort has been applied in order to seal the rotation of the rotors and the resulting pumps to date have been typically used in single stage applications. The rotors are each fitted on a shaft rotatably supported on bearings, either cantilevered or being fit with bearings at each end. The bearings are lubricated and separated from the process fluids by seals (commonly known as external bearings).

The usual approach for increasing the volume and fluid flow rate from such positive displacement pumps has been to increase the pump's dimensions. However, in the restricted space of a wellbore, such dimensional scale-up of pumps is not suitable for providing either the necessary pressure or the flows in the wellbore.

In some applications, such as hot, contaminated downhole wellbore operations, there is an objective to increase either the volumetric flow rate or to increase the output pressure beyond that which can conventionally be provided using a conventional circumferential piston pump. Conventional pump technology has not fulfilled these objectives. The design challenges are further increased where the fluid is hot and contaminated, further affecting the challenge of sealing the rotors of such pumps. In particular, in the high pressure, high temperature contaminated environment of oil well downhole operations, there is little opportunity to provide an optimum environment for the bearings.

The above problems and challenges are equally applicable to the reverse operation in which fluid is forced through such devices so as to drive a shaft and act as a motor.

Accordingly, there is a need for a fluid device which can operate in high temperature, contaminated fluids and which can be further adapted to operate in high volume and pressure operations, even in such restricted spaces as a wellbore.

SUMMARY OF THE INVENTION

The invention provides an improved positive displacement fluid device, such as a pump, having one or more pump sections, the pump sections being adapted for axial stacking which enables high volume, high pressure transport of high temperature production fluid which can contain a substantial degree of contamination. The novel pumping system overcomes the high temperature limitation as well as being associated with a high tolerance to pump contaminated fluids over a wide viscosity range. The capability to pump high temperature, contaminated fluids is achieved using a circumferential piston pump utilizing a novel sealing arrangement. Further, pump sections are stacked in parallel to achieve required flow rates. The parallel stacked pump sections are in turn stacked in series to meet required discharge head or pressure. Configured as a pump, the fluid device is driven by a drive shaft for pumping fluid. Configured as a motor, fluid is forced through the sections for turning and driving the shaft. Herein, the specification concentrates on a description of the fluid device as a pump although the principle and inventive concepts apply equally to a motor configuration.

In a preferred pumping configuration, the invention is a multi-chamber positive displacement fluid device or pump comprising two or more stacked positive displacement pump sections, each pump section having a rotor chamber for pumping fluid from an intake adapted for communication or connection with a fluid source to a discharge manifold and through a fluid discharge adapted for communication or connection to a fluid destination. Each rotor chamber contains rotors driven by common timed drive and idler shafts extending axially through each stacked rotor chamber. Each of the stacked sections has a common discharge manifold which contributes its incremental flow to the common discharge manifold. The sections can be stacked in any combination of parallel or series arrangements, each of which utilizes a drive shaft which extends co-axially through the stack of sections.

If the sections are stacked in parallel, the volumetric flow rate is incrementally increased.

If the sections are stacked in series, the discharge pressure capability is incremented. For a series arrangement, the discharge of one section or stack of sections is fluidly connected to the inlet of a successive stacked section through a crossover section. Sections stacked in series with a cross-over form a pumping stage for incrementally increasing the pressure at the fluid destination.

Applied as a motor for a given flow rate of fluid, sections stacked in parallel result in a greater torque at the drive shaft and sections stacked in series result in a greater rotation speed.

In a multi-section pump, the invention comprises: two or more axially stacked pump sections, each section having a rotor chamber and associated rotors for pumping fluid from an inlet to a discharge manifold and a drive which extends axially through each rotor chamber for rotating the rotors and pumping fluid. Each section comprises a pump housing for housing the rotor chamber and rotors which are sandwiched between end plates and seals.

In a multi-stage pump, the invention comprises: a suction stage have having one or more axially stacked suction pump sections, each section having a rotor chamber and associated rotors for pumping fluid from an inlet to a discharge manifold; and at least one pressure stage, each stage having one or more stacked pressure pump sections, each pressure pump section having a rotor chamber for pumping fluid from a suction manifold to a discharge manifold; a crossover section for fluidly connecting the discharge manifold of the suction stage to the suction manifold of the pressure stage; and a drive which extends axially through each rotor chamber for rotating the rotors and pumping fluid.

More preferably, the drive comprises a drive shaft or a plurality of co-axially connected drive shafts extending axially and rotatably to the rotor chamber of each section for rotating one of the rotors; an idler shaft or idler shafts extending rotatably to each rotor chamber for rotating the other rotor; and timing means between the drive shaft and idler shaft for contra-rotating the rotors.

The entire stack of sections and crossovers between stages can be fit into the bore of a tubular barrel, compressed sealably together and retained therein, the barrel forming a pump having a fluid intake or inlet ports to a suction stage and having a fluid discharge from a pressure stage.

Such a pump has great versatility in its designed flow capacity and lift, all of which can be assembled into a small diameter package and which is driven through a single drive shaft connection; ideal for downhole operations or other space restrictive areas. Configured as a motor, the fluid device demonstrates similar same space and performance advantages in meeting desired output torque and rotational speed characteristics.

BRIEF DESCRIPTION OF THE DRAWINGS

FIG. 9*a* is a perspective view with internal passageway depicted in hidden lines, FIG. 9*b* is top view of FIG. 9*a*, FIG. 9*c* is a cross-sectional view of FIG. 9*b* along lines A—A, and FIG. 9*c* is a cross-sectional view of FIG. 9*b* along lines B—B;

DETAILED DESCRIPTION OF THE PREFERRED EMBODIMENT

Figures 1A, 1B, 1C, 1D, 1E:
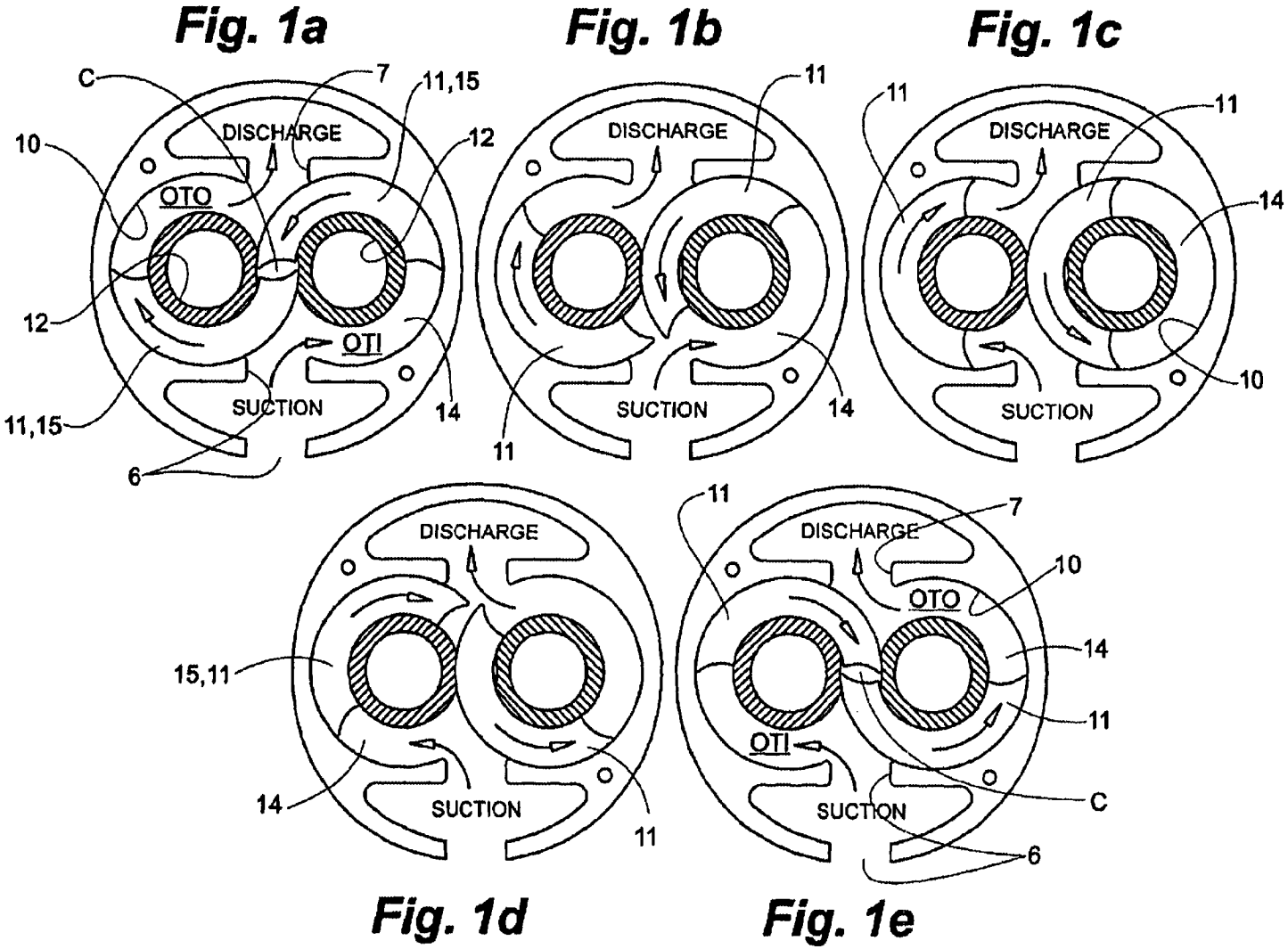
FIGS. 1*a*–1*e* are schematic views of the sequential operating principles of a circumferential piston pump.

The principles of positive displacement pumps are hereby adapted and modified for operation in environments known to be challenging to current pumping technologies. Positive displacement pumps include rotary-actuated gear pumps and circumferential piston pumps. When fluid operated in reverse, a positive displacement device can be used as a motor. Unless the context is specifically otherwise, the description herein applies equally to operation as a pump or as a motor.

In one embodiment a circumferential piston pump is applied to overcome the pumping challenges identified by the applicant. The principles of circumferential piston pumps are well known and are summarized briefly herein for reference.

Generally, and using illustrations of a circumferential piston pump as an example (FIGS. 1*a*–1*e*), a positive displacement pump comprises at least a rotor chamber 10, rotors 11 fitted into the rotor chamber, a fluid inlet 6 and a fluid discharge 7. In a single stage implementation, the inlet 6 is connected to a fluid source and its discharge 7 is connected to a fluid destination. In the case of an elementary gear pump, two rotors 11 such as meshing gears are rotated in the rotor chamber 10. The rotors 11,11 are contra-rotated for effective fluid flow—either being driven by the fluid as is the case for a motor, or driving the fluid as a pump.

Specifically for a circumferential piston pump, two contra-rotating piston rotors 11,11 are rotated in the rotor chamber 10 about cylindrical machined bosses 12. Annular piston bores 14 are formed between the rotor chamber 10 and the bosses 12. Each rotor 11,11 has one or more arcuate pistons 15 which travel in circular paths in their respective annular piston bores 14. The piston bores 14,14 meet at a common point of intersection C in the center of the rotor chamber 10. The center of rotation of each rotor is spaced outside of the major diameter (sometime known as external) of the opposing rotors. The point of intersection C of the piston bores 14,14 is connected at one side to the pump's inlet 6 and at an opposing side to the pump's outlet 7. Each piston 15 alternates passing through the point of intersection C. Each piston 15 has a trailing edge and a leading edge. As the trailing edge of a rotor's piston 15 leaves the point of intersection C, the volume of its piston bore is steadily yet temporarily increased, causing a suction and a resulting inflow of fluid from the inlet 6 or suction side. This is the suction portion of the cycle of each rotor 11. The leading edge of the same piston 15 then seals the piston bore 14 which traps the fluid drawn from the inlet 6 and positively displaces it to the outlet 7 or discharge side. While one rotor's piston 15 is displacing fluid out of its piston bore 14, the other rotor's piston 15 is drawing fluid into its piston bore 14. The suction inlet 6 and discharge outlet 7 are constantly isolated, despite the common point of intersection C, due to the continual presence of one rotor 11 or the other rotor 11 sealing between its respective piston bore 14 and against the opposing rotor's cylindrical boss 12.

In example sequential steps of operation, starting at FIG. 1*a*, an Open-to-Inlet (OTI) volume is defined in a rightmost rotor bore 14 by the rotor chamber 10 and by the departing the rightmost rotor piston 15. The rightmost rotor piston 15 fluid seals the OTI volume at the point of intersection C where the piston meets and seals against the opposing rotor's cylindrical boss 12. Comparing FIG. 1*a* and 1*e*, the OTI volume alternates between the piston bores 14,14 as the pistons 15,15 alternately enter or leave the point of intersection C. Normally, neither the rotors 11,11 nor the pistons 15,15 contact each other and only close tolerance fluid seals exist between the rotor 11 and the opposing rotor's boss 12. As the rightmost rotor bore 14 forms the OTI volume (FIG. 1*a*), an Open-to-Outlet (OTO) volume is defined in the leftmost rotor bore 14 by the rotor chamber 10 and the surfaces of rotor pistons 15 between their fluid seal contacts with the opposing boss 12 where they leave the point of intersection C. Observing the rightmost piston 15, FIGS. 1*a* and 1*b* illustrate the OTI suction portion of the cycle, while FIG. 1*c* illustrates the trapping of the fluid and its positive displacement towards the OTO volume. FIGS. 1*d* and 1*e* illustrate the continuous discharge of the trapped fluid to the outlet 7. As is shown in FIG. 1*c*, the OTI suction cycle for the leftmost rotor 11 begins when the rightmost rotor 11 is completed its OTI cycle.

In the conventional mode of operations, radial surfaces and axial-end surfaces of the rotor pistons 15 run in close-clearance contact with the walls of the rotor chamber 10, and due to the reality of manufacturing tolerances, load-bearing contact may occasionally occur in these zones. Annular apertures defined by the running clearances therebetween determine the amount of fluid leakage from the outlet 7 to the inlet 6, being from the OTO volume to the OTI volume, for a given pressure difference and a given effective viscosity. For each rotor chamber 10, each rotor 11,11 alternately supports the driving torque.

This ends a review of the more conventional aspects of the circumferential piston pump, the principles of which are common with positive displacement pumps generally and with the present invention. Such conventional pumps utilize a pump body or housing having a single inlet 6 and an outlet 7. The typical means for increasing a pump's volume (OTI,OTO) and fluid flow rate has been to increase the pump's dimensions. However, in the restricted space of a wellbore, such dimensional scale-up of pumps is not suitable for providing either the necessary pressure or the flows in the wellbore.

Figure 2:
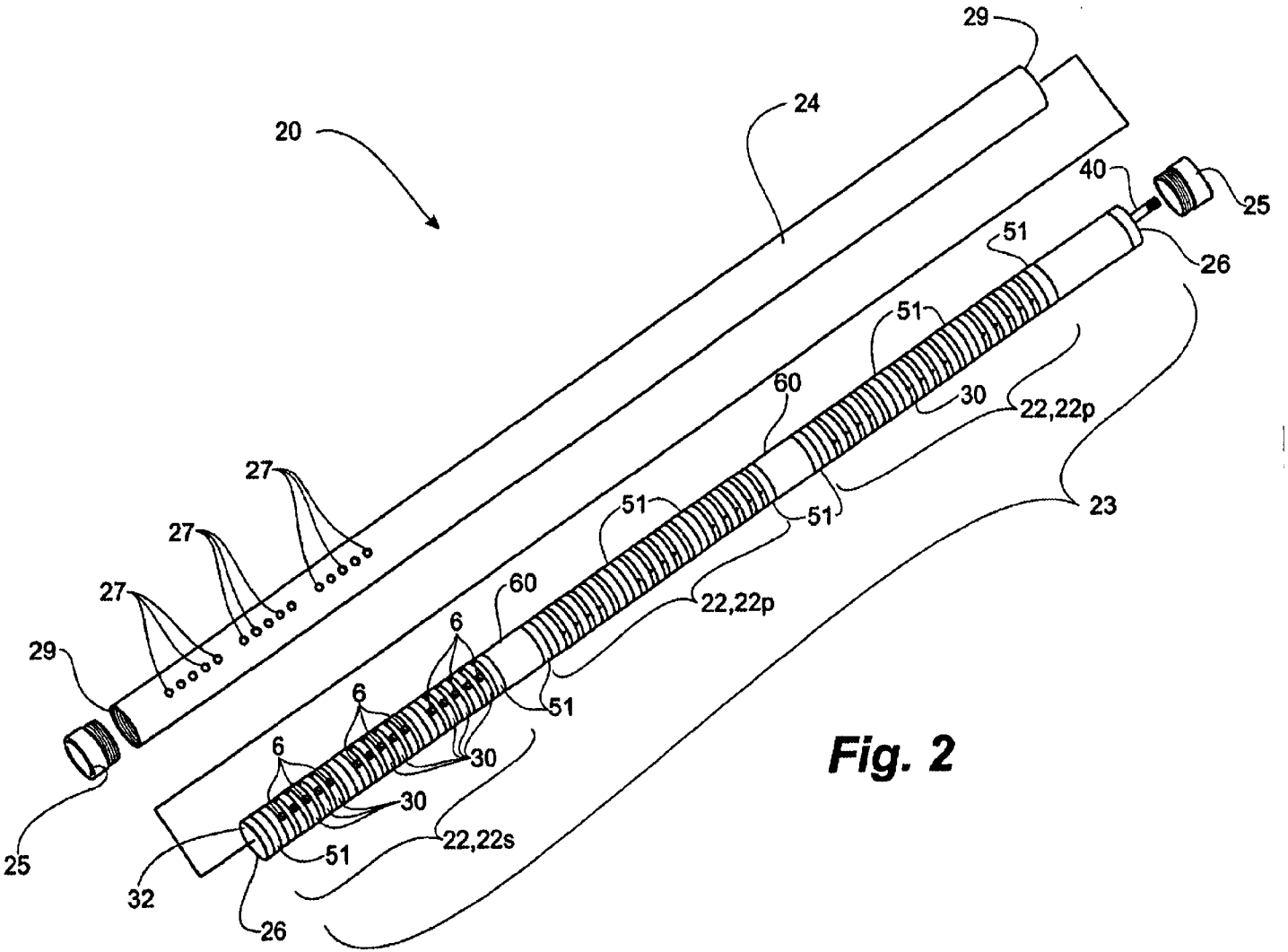
FIG. 2 is an exploded perspective view of a multi-stage circumferential piston pump according to one embodiment of the invention.
Figure 4:
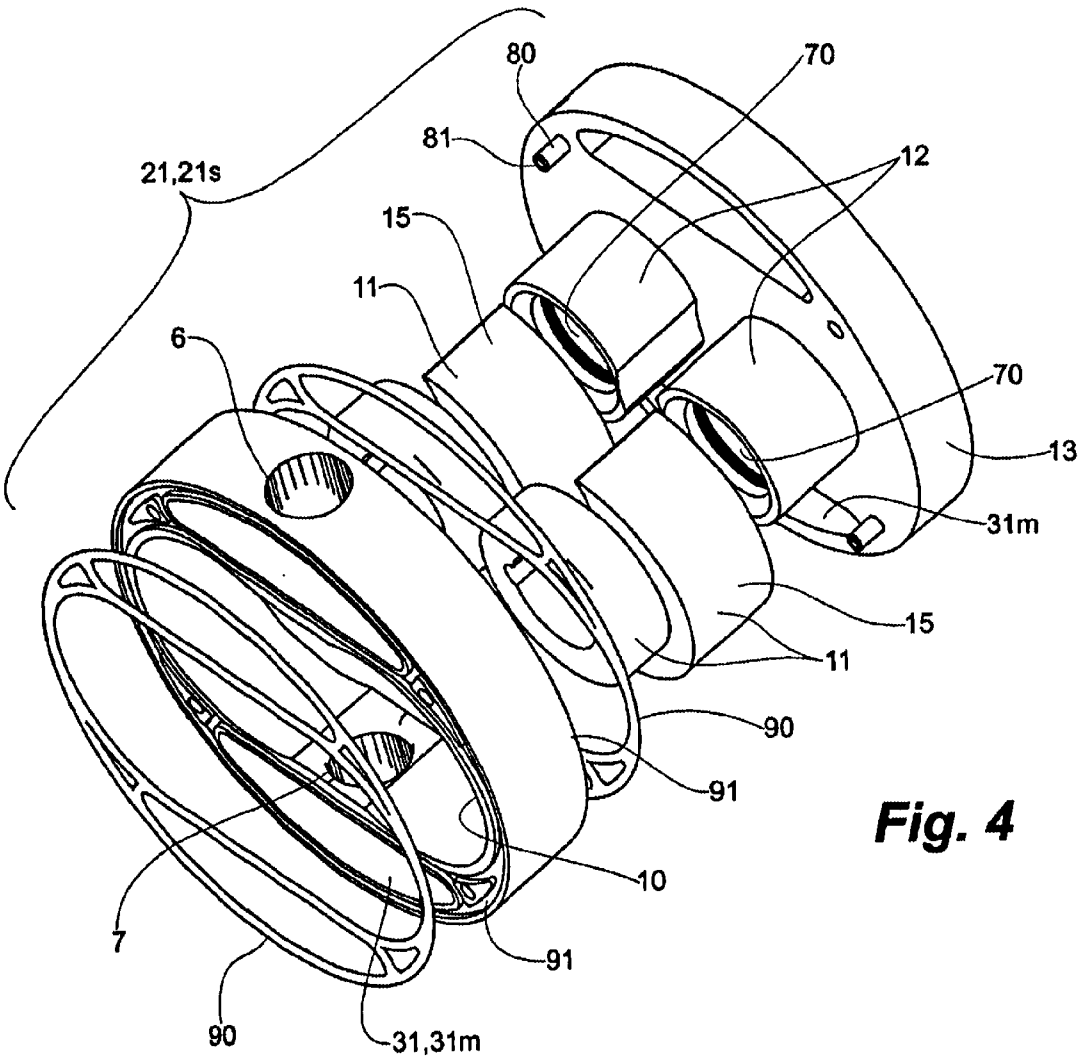
FIG. 4 is an exploded perspective view of a pump section configured as a fluid suction section.
Figure 5:
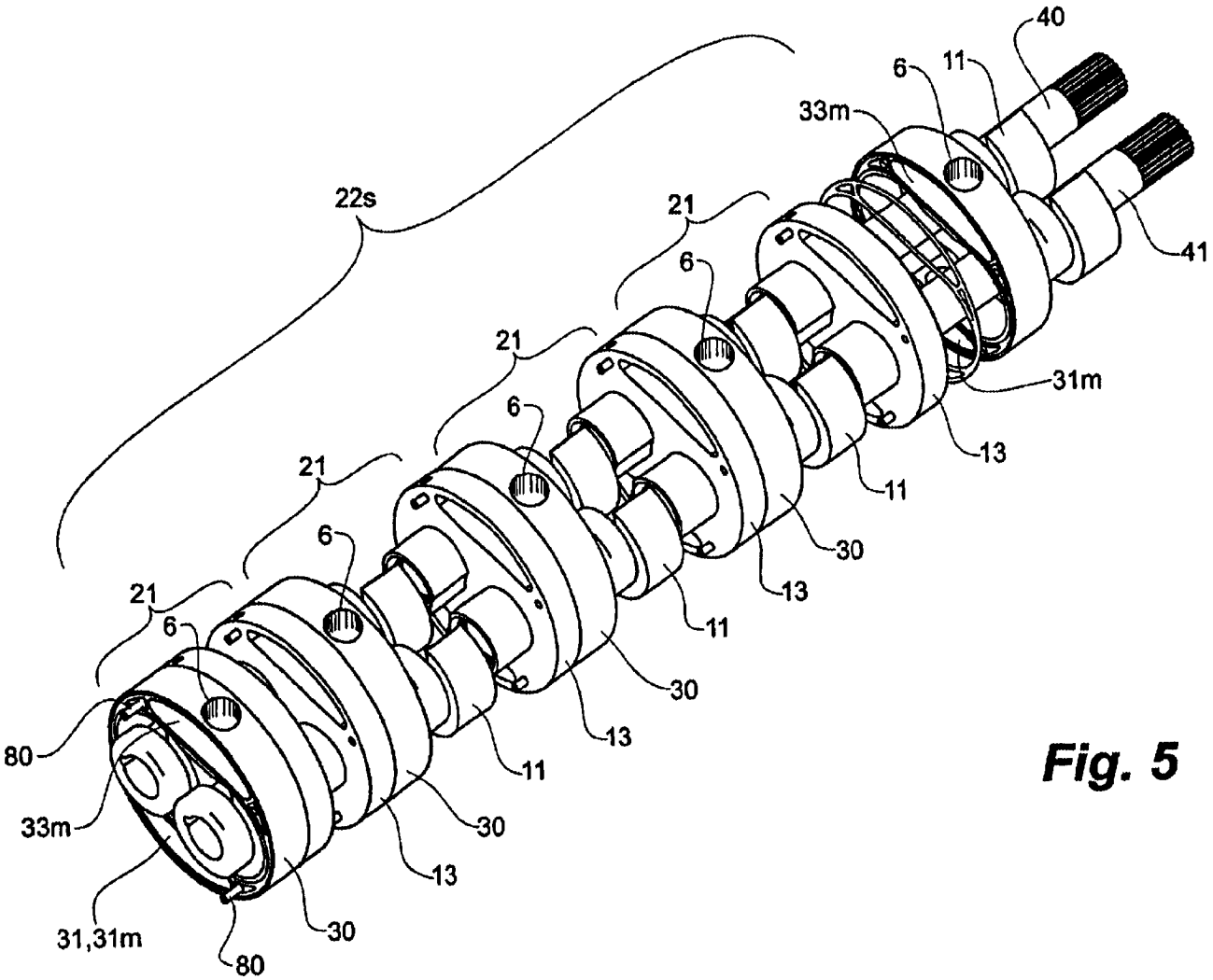
FIG. 5 is an exploded perspective view of a four parallel pressure pump fluid suction sections of FIG. 5, detailing main drive shaft and idler shaft sections.

Therefore, with reference to FIGS. 2 for the overall arrangement and FIGS. 4 and 5 for details, and turning to a first embodiment of the present invention, a novel pump 20 comprises two or more positive displacement chambers 10,10 . . . , stacked axially one chamber 10 atop another chamber 10. Each chamber 10 is provided with its respective rotors 11,11, bosses 12,12 and an end plate 13 for forming a section 21. In stacking the sections 21 and thus stacking the chambers 10,10 . . . , the respective rotors 11,11 of each discrete chamber 10 are aligned along the same axes and can thereby be driven through a common drive shaft and idler shaft.

Figure 6:
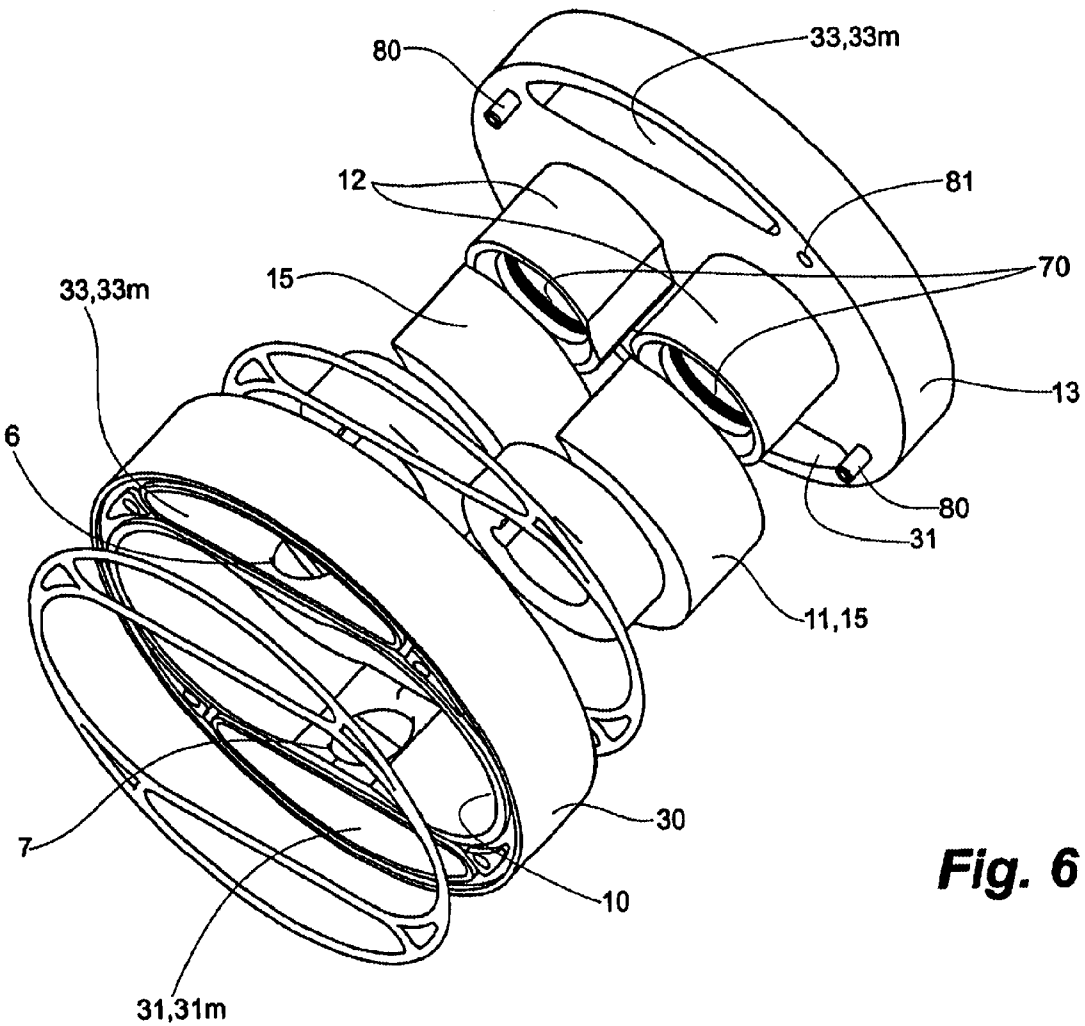
FIG. 6 is an exploded perspective view of a pump section configured as a pressure pump lift section.
Figure 7:
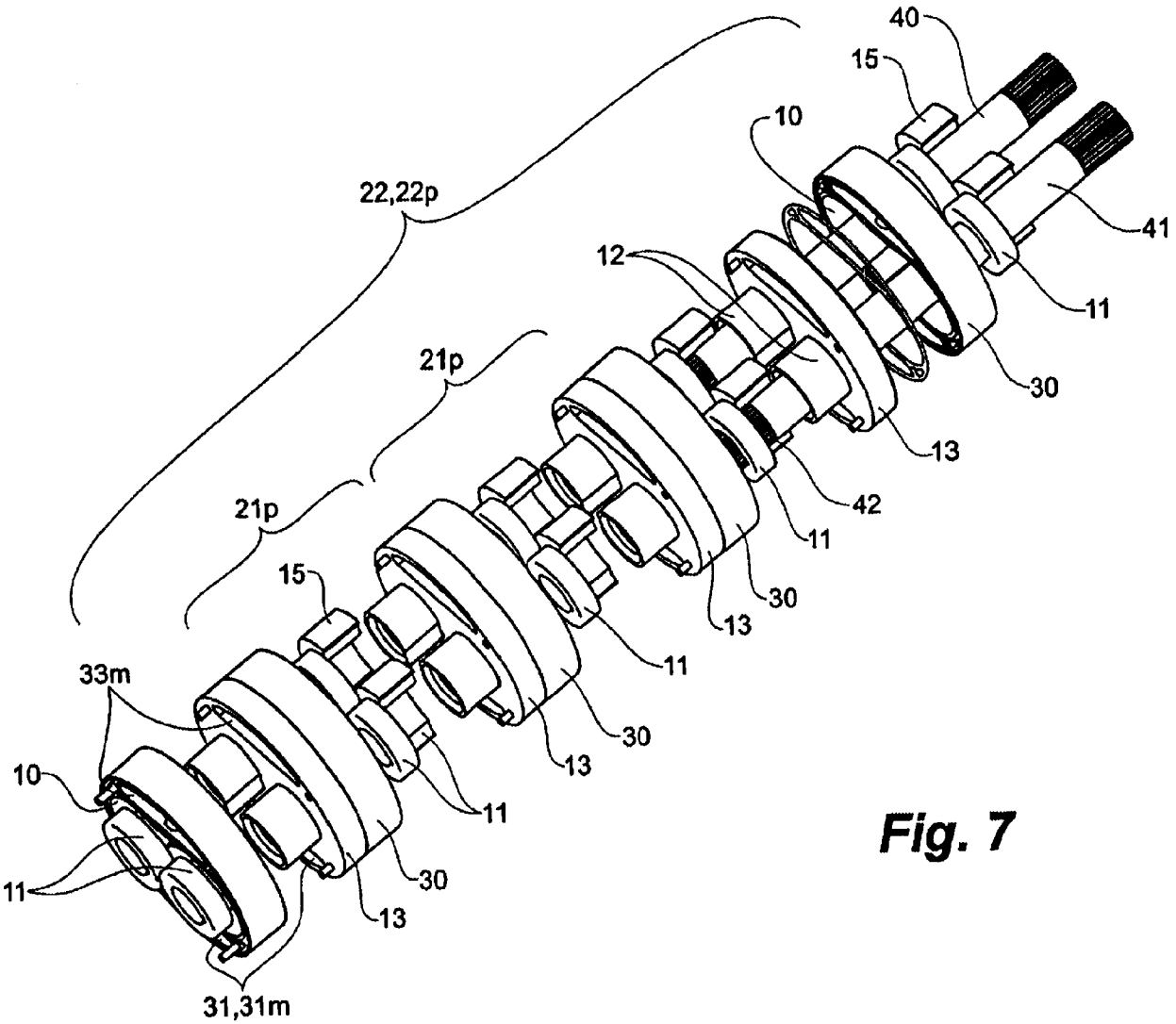
FIG. 7 is an exploded perspective view of four parallel pressure pump lift sections of FIG. 6, detailing main drive shaft and idler shaft sections.

Two or more stacked sections 21 having their outlets 7 conjoined into a common discharge are stacked to form a pump stage 22. A pump 20 can merely have a single stage 22 of one or more parallel stacked sections 21. Practically however, for increased head or discharge pressure, a pump 20 preferably comprises two or more stages; a suction stage 22*s* (FIGS. 4 and 5) and at least one pressure stage 22*p* (FIGS. 6 and 7).

Each stage 22, whether suction or pressure 22*s*,22*p*, comprises one or more pump sections 21 arranged or stacked axially in parallel for obtaining the desired capacity or fluid flow rates. Stages 22 can also be stacked axially in series 22*s*,22*p*,22*p*, . . . for obtaining the desired discharge pressure from the ultimate outlet from the pump 20.

As shown in FIG. 2, a complete pump 20 consists of pump sections 21 combined in multiples in a stack 23 and preferably having two or more stages 22 operating in series 22*s*,22*p*,22*p*.

The stack 23 of pump sections 21 and drive components (described later) are sandwiched together for fluid tight connections therebetween. While other means such as threading section 21 to section 21 together or joining by fasteners could be employed, one convenient means for assembling a multiplicity pump sections 21 and their associated drive components is to fit the stack 23 into an outer cylindrical retaining barrel 24. The length of the outer retaining barrel 24 is complementary to the overall height of the stack 23 so that when installed into the outer retaining barrel, end retaining nuts 25 are secured into each end of the outer retaining barrel 24 for engaging the stack ends 26 and retaining them together.

While each section 21 may actually be identical, the section's location in the stack can define its role as either a suction or a pressure section 21*s*,21*p*. A suction section 21*s*, multiple sections 21*s*,21*s* . . . , or a suction stage 22*s* is located adjacent to and in fluid communication with a fluid source and draws the design flow rate of fluid into the pump 20. As shown in FIG. 2, such a suction stage 22*s*, can draw fluid independently into each section 21*s*,21*s* . . . through a plurality of corresponding inlets 6,6 . . . in the sections 21 and corresponding inlet ports 27 in the outer retaining barrel 24. Alternately, as shown in FIG. 3, the fluid can be drawn through a combined suction intake 34.

With reference to FIG. 4, a section 21*s* configured for suction is illustrated. Each section 21 comprises a pump body or pump housing 30 forming at least two chambers: a pumping or rotor chamber 10 and a discharge chamber 31. For ease of manufacture and assembly, the rotor chamber 10 of each section 21 is sandwiched and sealed between end plates 13. A pair of bosses 12 extends from one side of the end plate 13 and project into the rotor chamber 10. The end plate 13 blocks one side of the rotor chamber 10, shown in this configuration as a top end plate for one pump section while also forming a bottom end plate for the next adjacent pump section. At an extreme bottom end of a stack of pump sections, a termination plate 32 without bosses is provided.

With reference to FIG. 5, four suction pump sections 21*s* are shown with the discharges 31 of each of the pump housings 30 and end plates 13 being aligned for forming a discharge manifold 31*m* for contiguous fluid passage therethrough. Inlets 6 are shown extending from the rotor chamber and through the pump housing 30. The pump housing, may or may not have a suction chamber 33 which mirrors the discharge chamber 31. In this embodiment, a suction chamber 33 would be a mere artifact of the implementation of pump housings which are interchangeable for either suction or pressure section use. As shown in FIG. 2, the assembled suction stage 22*s* draws fluid from a fluid source outside the pump 20, typically from a wellbore. Fluid enters the suction stage through a series of inlet ports 27 formed in the outer retaining barrel 24. The inlet ports 27 align with corresponding inlets 6 in each of the suction stages 21*s*; typically one inlet port 27 per suction pump section 21. While this arrangement does require some accuracy in matching inlet ports 27 and pump section inlets 6, use of individual inlet ports 27 does minimize fluid restriction and ensures a substantially equal supply of fluid to each pump section 21. Each suction pump section 21 transports substantially an equal amount of fluid from the inlet 6 and delivers it to the common discharge manifold 31*m* which is located 180 degrees opposite to the suction manifold 33*m*. The discharge manifold 31*m* runs along the full axial length of each pump stage 22*s*,22*p* . . . , through both the pump housings 10 and the end plates 13 for accumulating and delivering the discharge fluid to the next pump stage 22.

Figure 3:
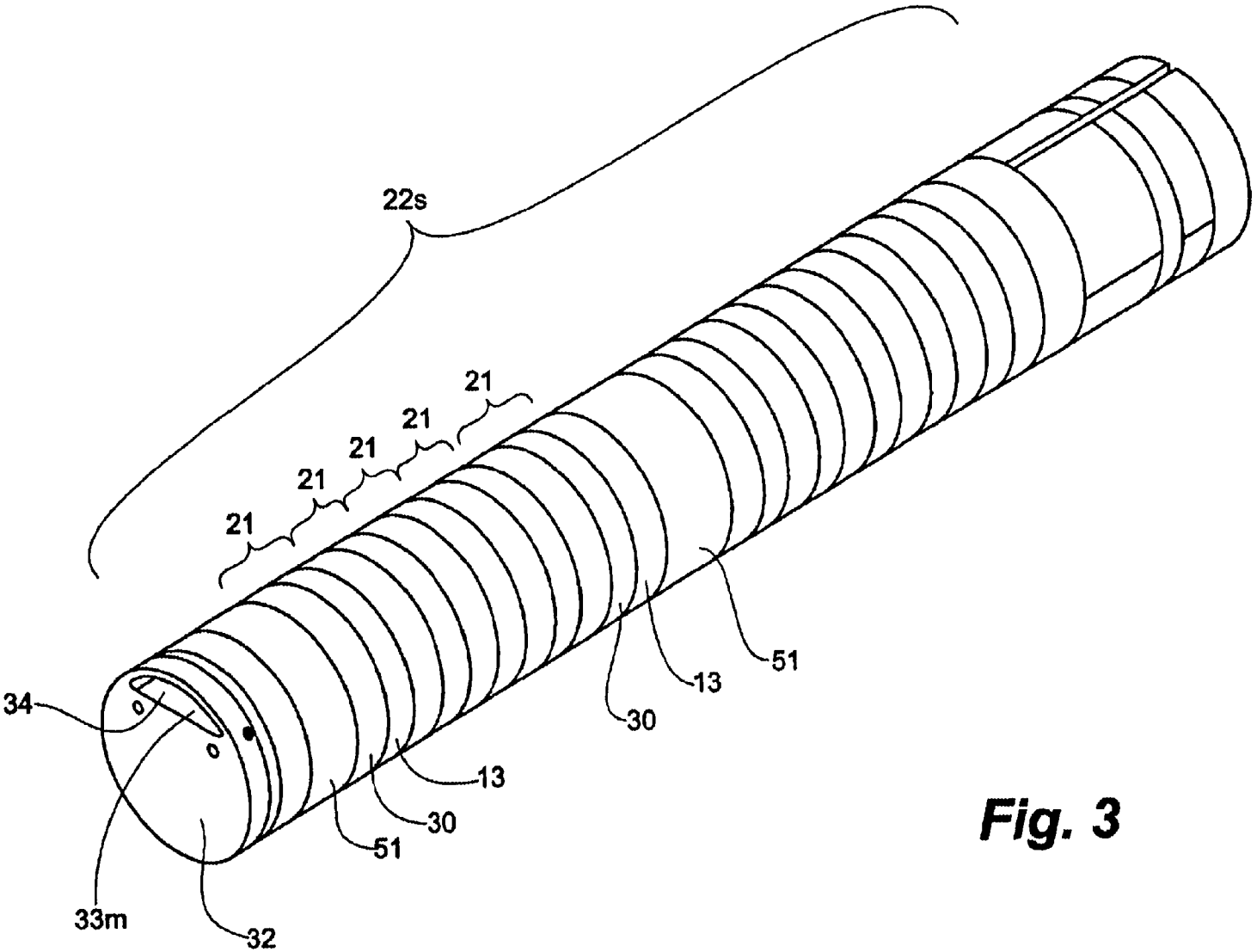
FIG. 3 is a perspective view of an alternate suction stage according to another embodiment, in which the inlets ports for all pump sections draw from a common suction manifold.

In the alternate embodiment shown in FIG. 3, the multiple-stacked chambers of the suction stage 22*s* can all draw from suction intake 34. The suction sections 21*s*,21*s* . . . have their inlets 6 extending only from the rotor chamber 10 to a suction chamber 33 as part of an overall common suction manifold 33*m*. This simplifies the pump assembly and avoids the need to accurately align individual section inlets 6 with the inlet ports 27 in the outer retaining barrel 24. Accordingly, a common or combined suction intake 34 is formed at the initial suction section 21*s* or the suction stage 22*s*. The intake 34 is formed in the termination plate 32. In this embodiment, the suction manifold 33*m* is required to pass the entire design fluid flow rate, and thus the pressure drop therethrough must be considered in the design such as increasing the manifold 33*m* cross-section accordingly. The suction manifold 33*m* may have sufficient cross-sectional areas to supply fluid to all of the multi-chambers 10 in the stage 22 without starving the latter sections 21 of fluid flow. The suction manifold 33*m* for all pump sections 21 may be increased in size. The inlets 6 for each section 21 are all joined through the common suction manifold 33*m*. In the alternate embodiment in FIG. 3, it is clear that the pressure and suction sections 21*p*,21*s* may be identical for simplification and economy of manufacture.

Turning to FIG. 6, a pressure pump section 21*p* is shown herein as differing from an independent Inlet operating suction pump section 21*s* by the absence of an inlet 6 extending through the pump housing 30 which forms a suction manifold 33*m*. As shown individually In FIG. 6 and stacked in FIG. 7, the pressure pump sections 21*p* correspond in all other respects to the suction pump sections 21*s* set forth in FIGS. 4 and 5 except that the suction chamber 33 now forms the inlet to each section 21. The suction chamber 33 Is isolated from the outer retaining barrel 24 and is enclosed wholly within the pump housing 30. A pressure stage 22*p* is typically configured to accept fluid from the suction stage's common discharge, process the fluid through the one or more sections 21*p* in parallel and also discharge the fluid through a common discharge 31 or manifold 31*m*.

The end plates 13 are also fitted with suction and discharge chambers 33,31 which are complementary to the pump housing's suction and discharge chambers 33,31 for forming respective suction and discharge manifolds 33*m*, 31*m* extending continuously along the pump 20 for contiguous fluid communication between stacked pump stages 22*s*,22*p*,22*p* . . . As noted above, end plates 13 throughout a suction stage 22*s* may or may not include a suction chamber 33 as the suction section's pump housing 30 may be absent such a chamber, being fitted only with an inlet 6.

With reference to FIG. 7, four pressure pump sections 21*p*,21*p* . . . are shown with each of the respective suction and discharge manifolds 33*m*,31*m* of the pump housings 30 and end plates 13 being aligned for contiguous fluid passage therethrough.

Rotors 11 and their pistons 15 are mounted rotatably over the bosses 12 for rotation in the rotor chamber 10. Single lobed rotors 11 are shown although double lobed or other rotor arrangements are possible. In U.S. Pat. No. 2,642,808 to Thomas, the entirety of which is incorporated herein by reference, double-lobed rotors are implemented. Further, the circumferential piston 15 can extend axially from the rotor 11 to overhang the boss 12, as illustrated herein, or can be cantilevered, as taught by Thomas.

Accordingly, and referring to FIGS. 2 and 4–7, when assembled into a typical pump 20 configuration, a suction stage 22*s* is demonstrated as having fifteen stacked suction pump sections 21*s* and fifteen corresponding inlet ports 27. All fifteen suction pump sections 21*s* discharge to the common discharge manifold 33*m*. The fluid in the suction stage's discharge manifold 31*m* is directed to a first pressure stage 22*p*. The first pressure stage 22*p* is also illustrated as having fifteen stacked pressure pump sections 21*p*. All fifteen pressure pump sections 21*p* draw from a common suction manifold 33*m* and discharge to a common discharge manifold 31*m*. The fluid in the first pressure stage's discharge manifold 31*m* is directed to a second pressure stage 22*p*. The second pressure stage 22*p* is also illustrated with fifteen pressure pump sections 21*p*. All fifteen pressure pump sections 21*p* also draw from a common suction manifold 33*m* and discharge to a common discharge manifold 31*m*.

Figure 8:
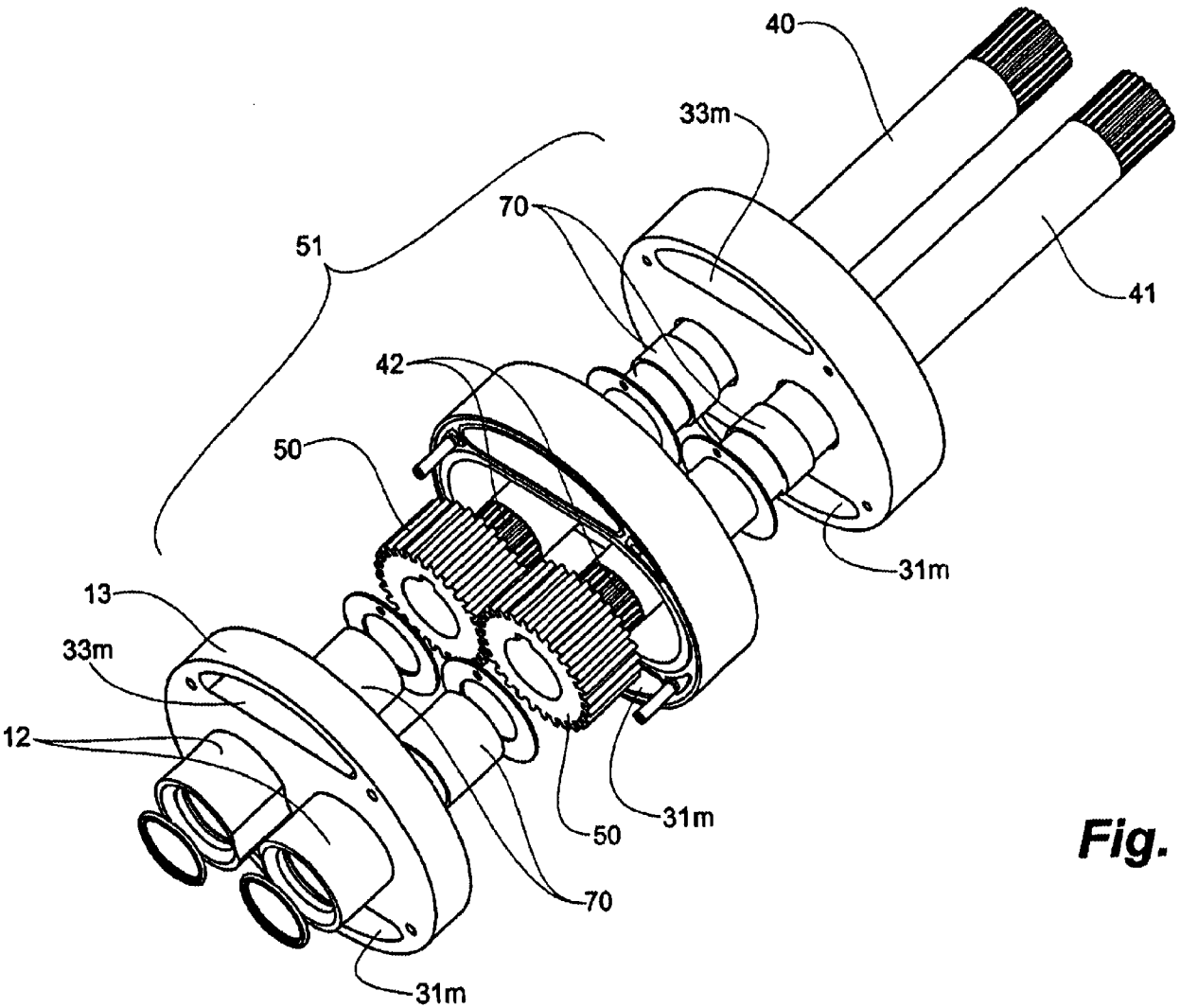
FIG. 8 is an exploded perspective view of a center timing gear assembly.

Turning to FIGS. 7 and 8, one rotor 11 is driven by one or more drive shafts 40,40 . . . which extend through each rotor chamber 10 and which are connected end to end for co-rotation. The opposing rotor 11 is driven by one or more idler shafts 41,41 . . . which are also connected end to end for co-rotation. The one or more drive shafts 40 and one or more idler shafts 41 are hereinafter referred to collectively and simplistically as singular drive shaft 40 and idler shaft 41 respectively.

As shown in FIGS. 7 and 8, the pump sections 21 are driven using the drive shaft 40, extending axially through each pump section 21 and connecting driven rotors 11 in each stacked pump stage 22. The rotors 11 in each pump stage 22 rotate in the same contra-rotating directions as they are driven by one common input main drive shaft 40. The opposing rotor 11 in each pump section 21 is driven by paired sets of timing gears 50, connected to the drive shaft 40 and the parallel idler shafts 41. The plurality of discontinuous, yet co-axial, conjoined idler shafts 41 each being driven through the timing gears 50. The timing gears 50 have a dual function: to drive the idler shaft 41 and their associated rotors 11, and to ensure that the rotors' pistons 15 are timed correctly so that they do not contact or clash.

A person of skill in the art can design one or more shafts 40,40 . . . and 41,41 . . . for assembly into a single co-rotating shaft 40 or 41. As shown in FIG. 7, an individual shaft 40 or 41 may be conjoined at splined connections 42 at its respective and common rotor 11. For example, the ends of the shafts 40,41 can be fitted with an external involute spline 42 which fits cooperatively with an internally splined coupling bushing (or rotor 11 or gear 50) to co-axially connect the shaft sections of each of the stacked pump stages 22. Further, as shown in FIG. 8, the shafts may be conjoined with splined connections at the timing gears 50.

The timing gears 50 are housed in timing assemblies 51,51 . . . which are located at regular intervals between multiple stacked pump sections 21, and thereby provide accurate timing for the piston sections 21,21 . . . Typically, a timing assembly 51 is sandwiched between every four of five pump sections 21. The timing gears 50 are contained in separate timing assemblies 51, fully integrated in each pump stage 22.

Regardless of the form of connection to a fluid source, the common discharge manifold 31*m* of the suction stage 22*s* delivers pumped fluid to the next successive pump stage 22, in this case being the first pressure pump stage 22*p*. The first pressure stage 22*p* and successive pressure pump stage 22*p* is similar in design and construction to the previous suction pump stage 22*s*, excluding the suction inlets 6 and inlet ports 27.

At the discharge of each stage 22, such as between the suction stage 22*s* and a pressure stage 22*p*, the discharge manifold 31*m* is routed to the suction manifold 33*m* of the successive pump stage. In order to maintain common rotational axes for the drive shaft 40 and idler shaft 41, and to pump the discharge flow to the common suction manifold 33*m* of the successive stage 22*p*, the fluid needs to cross-over 180 degrees to flow into the common suction manifold 22*s* of the successive stage 22.

Figure 9C:
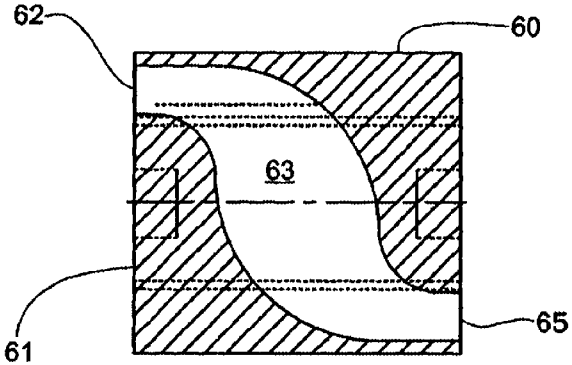
FIGS. 9*a*–9*d* are various views of a fluid cross-over unit. More particularly.
Figure 9B:
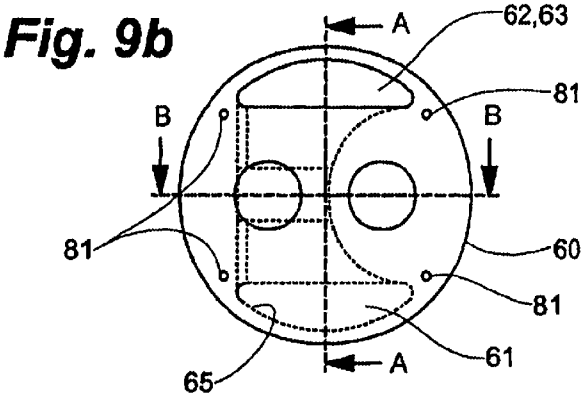
Figure 9A:
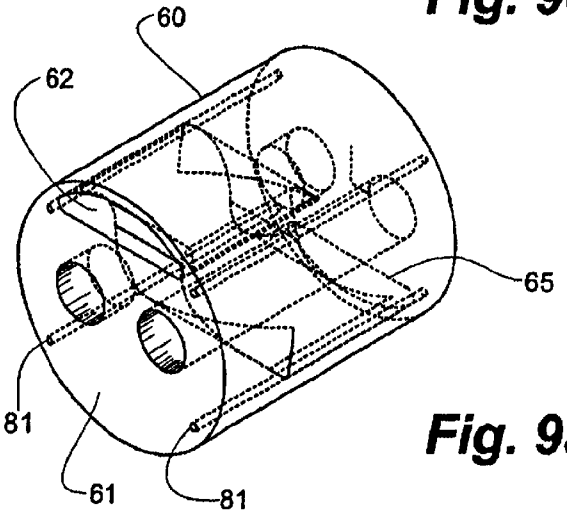
Figure 9D:
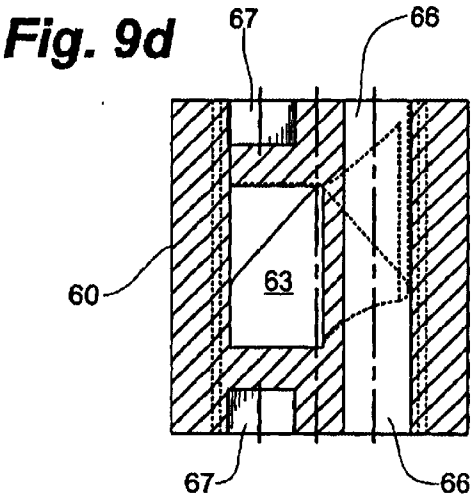

With reference to FIGS. 2 and 9*a*–9*d*, a fluid flow cross-over section 60 comprises a cylindrical block forming an end wall 61 for blocking the preceding stage's suction manifold 33*m* and a fluid inlet 62 for accepting fluid flow from the preceding stage's discharge manifold 31*m*. The fluid from the preceding stage's discharge manifold 31*m* is routed through a fluid flow passage 63 to a fluid outlet 65. The fluid outlet 65 is arranged for discharge into the suction manifold 33*m* of the successive stage 22. As shown in FIGS. 9*b* and 9*d*, the cylindrical block is fitted with a bore 66 for forming a through passage for the drive shaft 40. The idler shafts 41, being driven by timing assemblies 51 positioned periodically along the pump, are able to terminate either side of the cross-over section 60. Accordingly, the fluid flow passage 63 is neither obstructed nor interrupted by the drive shaft 40 or idler shafts 41,41.

Sockets 67 and bearings (not shown) are provided for the termination of a preceding idler shaft and for the termination of a successive idler shaft. Such sockets 67 can be machined into the cross-over section 60 or into specialized end plates (not shown) which can be provided as matter of economics so as to avoid further machining of the cross-over section 60.

As known by those of skill in the art of positive displacement pumps, each rotor 11,11 is rotated in close non-contacting tolerance to their respective bosses 12,12 and to the rotor chamber 20 and the opposing rotor 11 so as to effect a positive displacement motoring or pumping action. To maintain such operational tolerances, the rotors 11,11 are mounted securely to their respective shafts 40,41 and the shafts themselves are supported concentrically in the bosses 12,12 using bearings 70. Unlike the conventional wisdom applied to such circumferential piston pumps, the bearings 70 employed herein are not supported external to the rotor chamber in a protected environment. Recognizing the oft times harsh conditions experienced by pumps in hot, or contaminated environments, face-to-face hard bearing surfaces, including tungsten carbide, silicon carbide, and ceramics are provided inside each boss 12,12 and on the corresponding locations on the main drive shaft 40 and idler shaft 41. Best shown in FIGS. 6 and 8, bearings 70 are fit into each boss 12. Mating bearings 70 are also fit to the shafts 40,41 (obscured in FIGS. 6 and 8—an example shown in FIG. 8). Similar complementary bearings 70 are employed in each timing assembly 51.

Best seen in FIGS. 4 and 6, sealing between the individual components of the pump housings 30, end plates 13, timing assemblies 51, and fluid cross-over sections 60 is accomplished using specially molded high temperature O-ring seals 90. The seals 90 are fitted in corresponding shaped grooves 91 formed in each pump housing 30, providing full sealing around the perimeter of each chamber 30, each stacking Interface and each individual lubricant and instrumentation port hole 81, running through the full length of the pump stage 22.

As discussed earlier, each complete assembled pump stage 22 is mounted inside an outer retaining barrel 24 for supporting the complete assembly. Accordingly, each complete stacked pump stage 22 is free of any internal mechanical fasteners.

The outside pump retaining barrel 24 is precision ground and polished on its inside diameter, and provides close tolerance support for each internally mounted section 21,21 and stage 22. The extreme ends 29 of the outer retaining barrel 24 are internally threaded, and each match with the externally threaded retaining nut. The retaining nut 25 can also be provided by a threaded fluid cross-over 60. Once the retaining nuts 25 are threaded into each end of the outer retaining barrel, they sandwiches the stacked pump sections 21 and stages 23 together, compressing the O-ring seals 90 and thereby providing full internal sealing of the internal pump stage components 21,51,60.

The assembly is aided by compressing the stack of pump components 21,51,60 using opposing mandrels. The end retaining nuts 25 are then threaded into each end of the outer retaining barrel to retain the compressed stack in the outer retaining barrel 24. Depending upon the number of sections 21 for the particular pump configuration, and as an example, for three stages of fifteen sections/stage about 10,000 to 20,000 pounds force is applied.

In operation, each stage of a circumferential piston pump produces a characteristic pulsing at each discharge. Accordingly, and in a preferred aspect, such pulsing is minimized by slightly rotationally incrementing each pair of rotors 11,11 for each successive section 21,21. One approach is to mount the rotors 11,11 on the drive shafts 40 and idler shafts 41 such that the pump OTI/OTO timing for a complete pump stage 22 is incremented, at equal angular intervals throughout the entire 360° shaft circumference, so as to equally divide the pulsing throughout each 360 degrees revolution. The resulting fluid flow has an overall reduced variation in pulsation at the discharge manifold 31*m* and provides continuous low pulsation fluid intake and fluid flow discharge characteristics. For example, for a stage 22 having fifteen pump sections 21, each rotor 11 of a rotor pair would be incrementally rotated about 24 degrees on the main drive shaft (360/15). The rotors 11 are connected to the drive and idler shafts 40,41 by means of splines 42 and shaft keys (not shown). As is the convention in rotating machines, shaft keyways are rounded with radius ends, to reduce stresses on the shafts 40,41.

Figure 10:
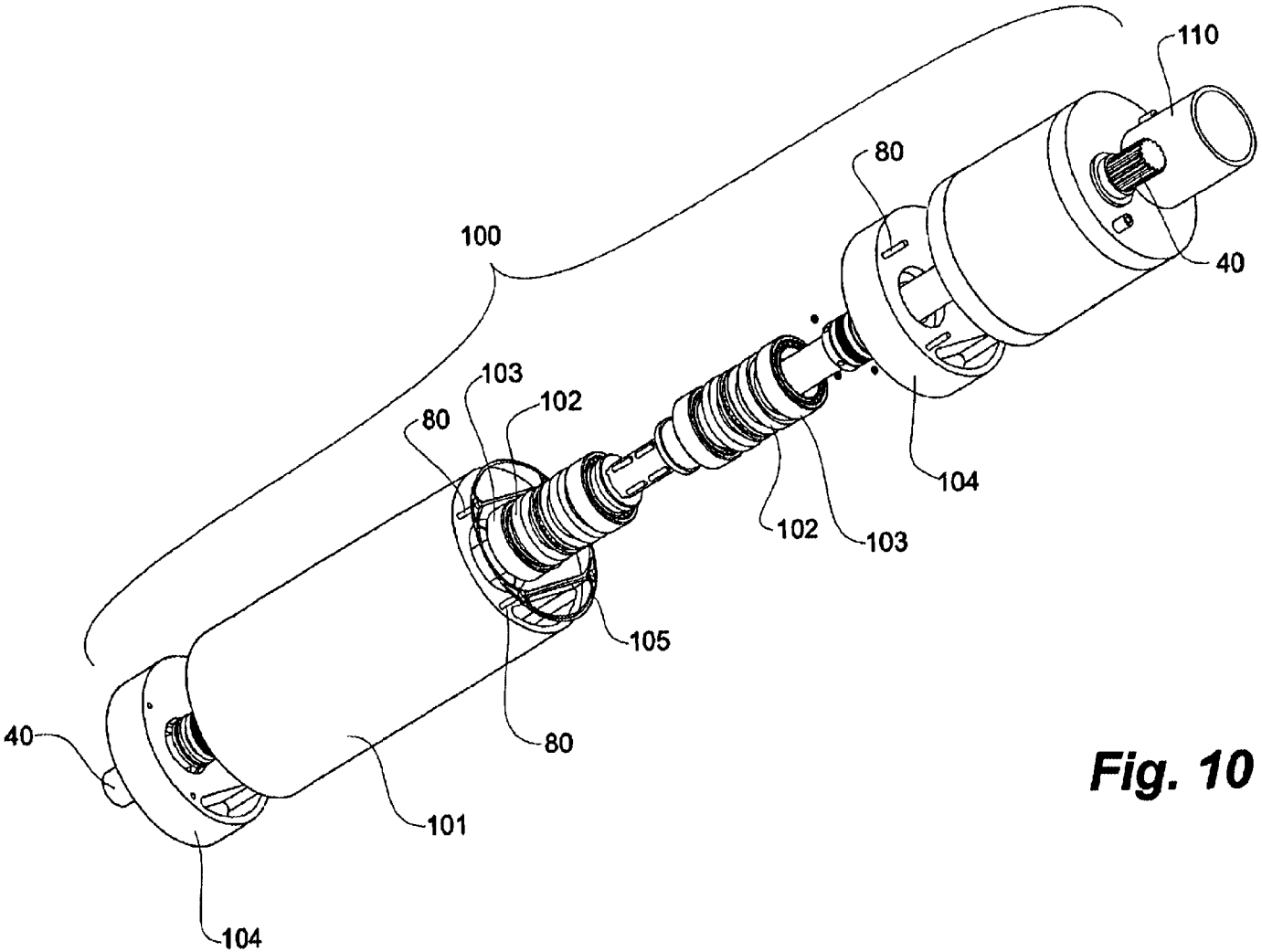
FIG. 10 is an exploded perspective view of a top bearing assembly.

Referring to both FIGS. 2 and 10, the drive shaft 40, running through the full length of the complete pump 20, is supported at the discharge end of the pump 20 by a thrust/ radial bearing assembly 100. The thrust bearing assembly comprises a bearing housing 101 located on top of the uppermost pump stage 22*p*, and forms an integral part of the pump 20 when installed into the outer retaining barrel 24. The thrust bearing assembly 100 contains double thrust bearings 102,102 and double radial bearings 103,103 fit with bearing housings 104 to prevent axial and radial driveshaft movement. The bearing assembly 100 is a sealed unit, with high temperature mechanical seals 105,105 located at the upper and lower end of the drive shaft bearing assembly 100. The bearing assembly 100 is filled with high temperature lubricant oil to lubricate the bearings 102,103. The bore of the bearing housing 101 contains the combined stack of bearings 102,103 and has an additional lubricant oil reservoir 106 surrounding the bearing assembly 100. The reservoir 106 can be refreshed or topped up through a lube oil connection (not shown) at the top of the pump 20 adjacent the production line connection 110.

Alignment of the stacked components 21,51 is accomplished by hollow alignment dowels 80, located in integral lubricant/instrumentation galleries 81 running through the full length of the complete pump 20. Each pump housing 30, end plate 13, timing assembly 51 and fluid cross-over section 60 have such galleries 81 into which are fit hollow dowels 81 for alignment as well as for lubricant instrumentation purposes. Each pump section 21 is located and rotationally locked to the adjacent section 21 using the dowels 80. Further, through the use of hollow dowels 81, one through four galleries 80 can be formed along the length of the pump 20. For example, the oil reservoir 106 surrounds the bearing assembly 100 and is also supplied with lubricant externally through one of the galleries 80 running through the full length of the pump 20.

Figure 11:
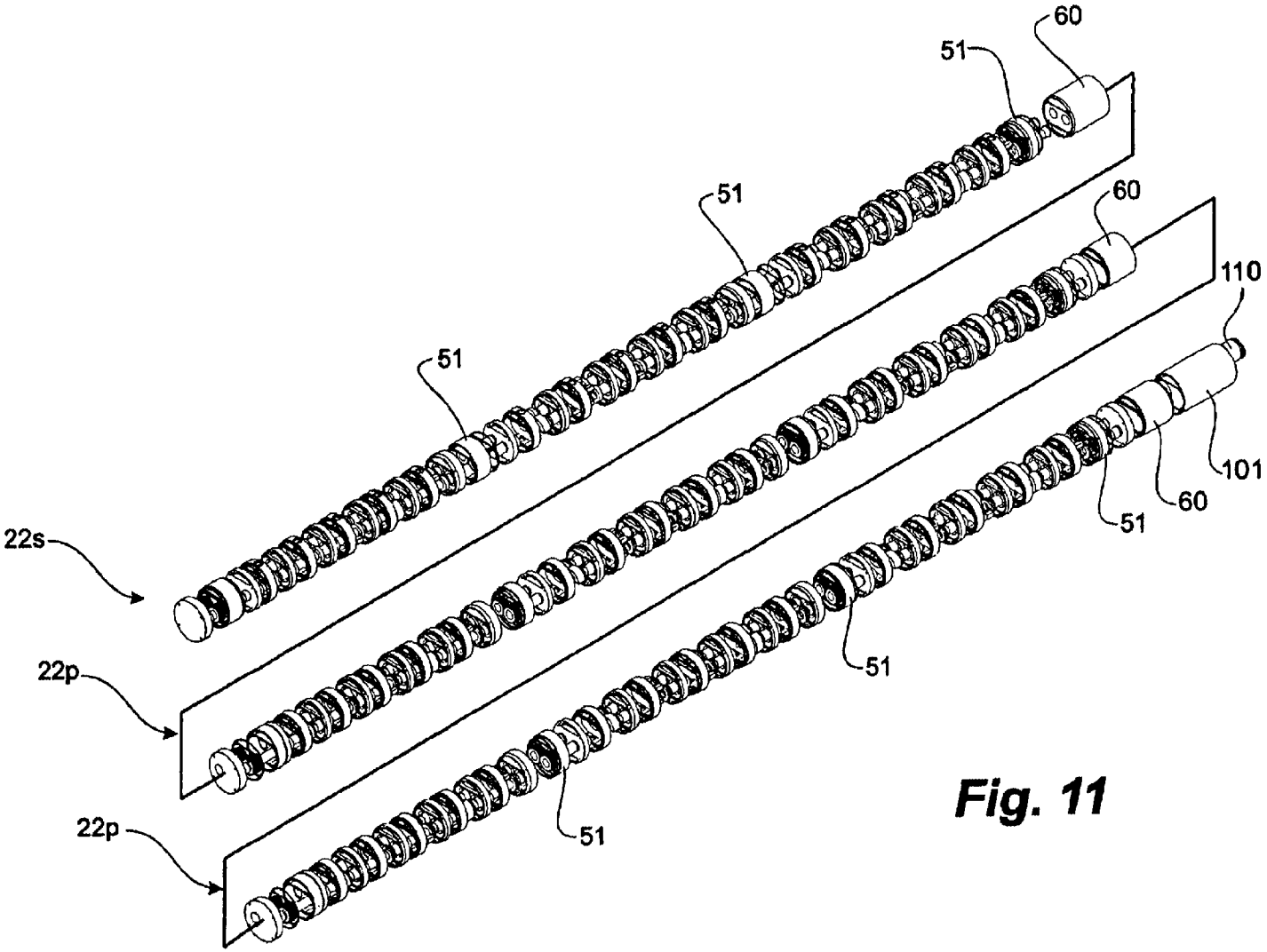
FIG. 11 is an exploded perspective view of a complete pump assembly with outer retaining barrel omitted.

As shown in FIG. 11, assembly of the pump sections 21 comprises first stacking each of two or more pump housings 30 and rotors 11,11 between end plates 13,13. The end plate's bosses 12,12 center and locate the rotors 11,11 in the pump housing 30, and also rotatably support the main drive shaft 40 and idler shaft 41 bearings 70. Pump housings 30 and end plates 13,13 are stacked back to back, with timing assemblies 51 at regular intervals, to form one or more stages 22. As shown in FIG. 2, the entire stack 30,13,51 . . . is compressed and installed in the outer retainer barrel 24 for form the complete pump 20.

The discharge fluid is delivered from the uppermost pump stage 22*p* via the common discharge manifold 31*m* to a last cross-over section 60, connecting to the production pipe line 110 for directing the fluid to the fluid destination. In a pump 20 fit to a wellbore, the fluid destination would be the earth's surface.

EXAMPLE

Operations for a pump 20 capable of operation in a 9⅝" wellbore casing include a plurality of 8" diameter pump housings 30 comprises a suction stage 22*s* and two pressure stages 22*p*,22*p*. Each pump section 20 has a rotor chamber 10 and rotor 11,11 combination having a displacement of 0.833 liters per rotor revolution. Timing gears 50 are provided every five pump sections 21, or three assemblies 51 per stage 22. Rotational speed of the pump sections 21 can vary between about zero to over 600 rpm, limited only by mechanical constraints such as the means for driving the drive shaft and depending on the characteristics of the fluid. Operating with drive means such as conventional top drives rotating at 400 rpm, such a pump 20 can produce flow rates of about 1000 liters/minute at 4500 kPa on fluid such as oil having gravity and viscosity equivalent to fluid similar to a SAE30 oil.

Figure 12A:
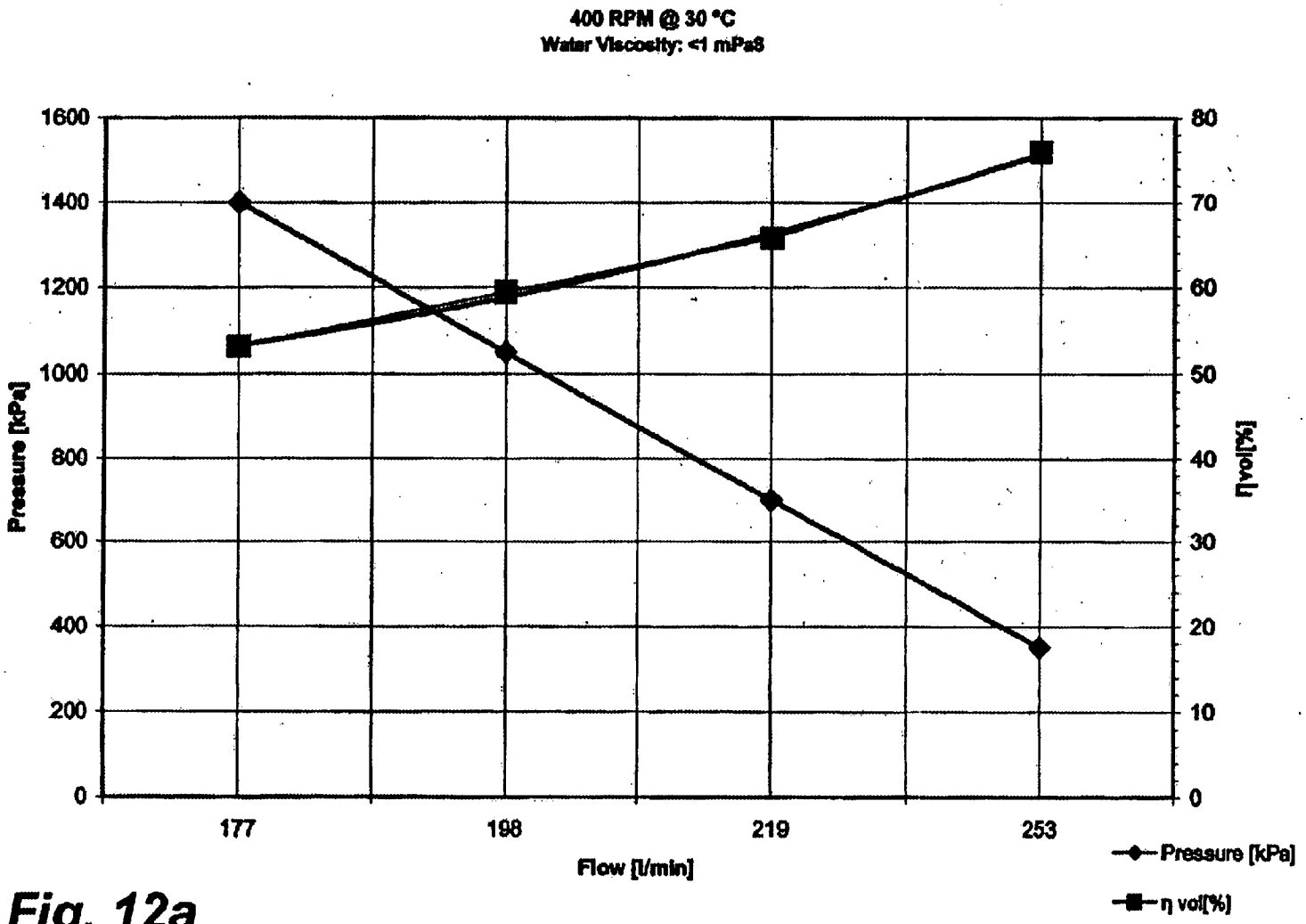
FIGS. 12*a*–12*c* are test results depicting the efficiency, power and torque curves for a five section portion of a pump constructed according to the embodiment of FIG. 2 when pumping water at standard conditions.
Figure 12B:
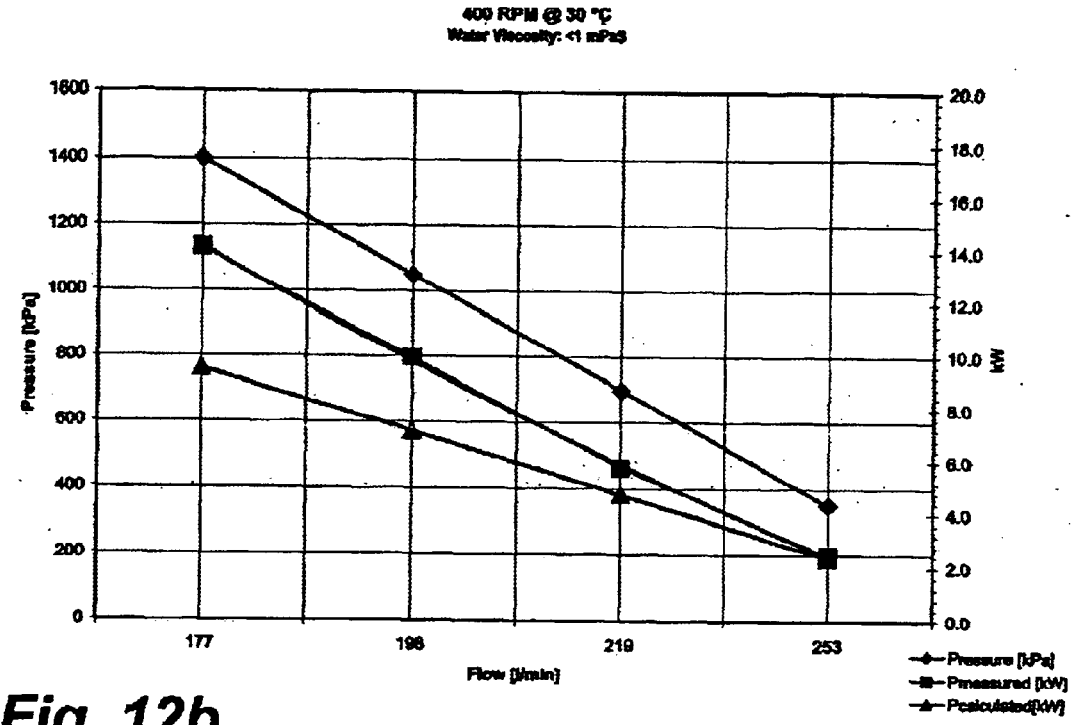
Figure 12C:
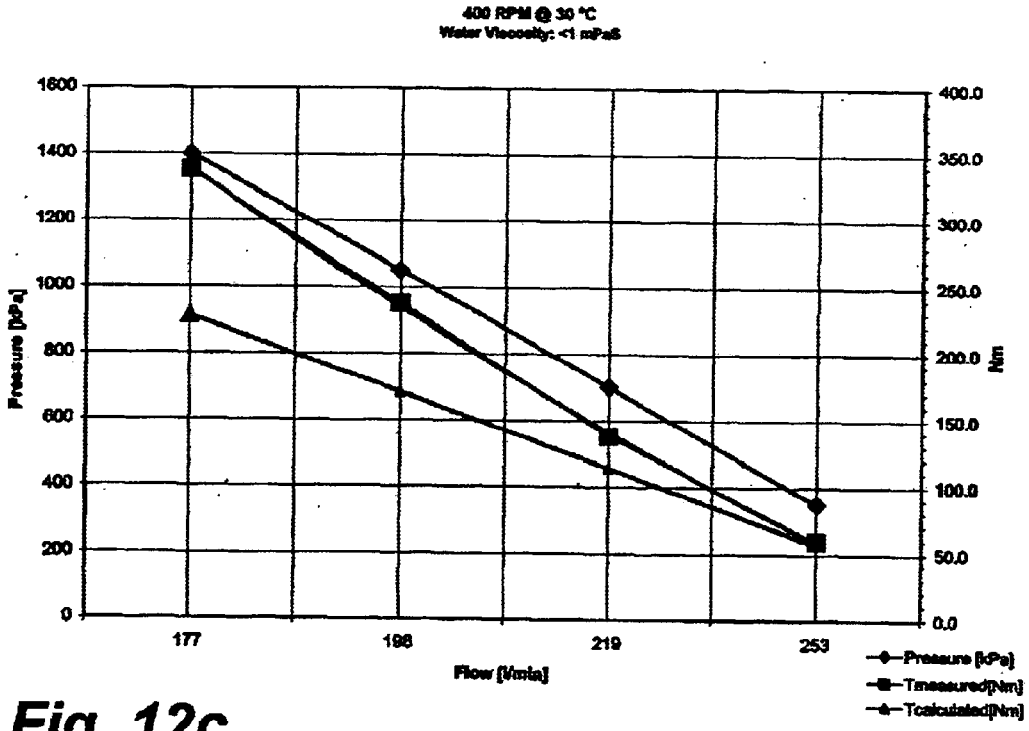
Figure 13A:
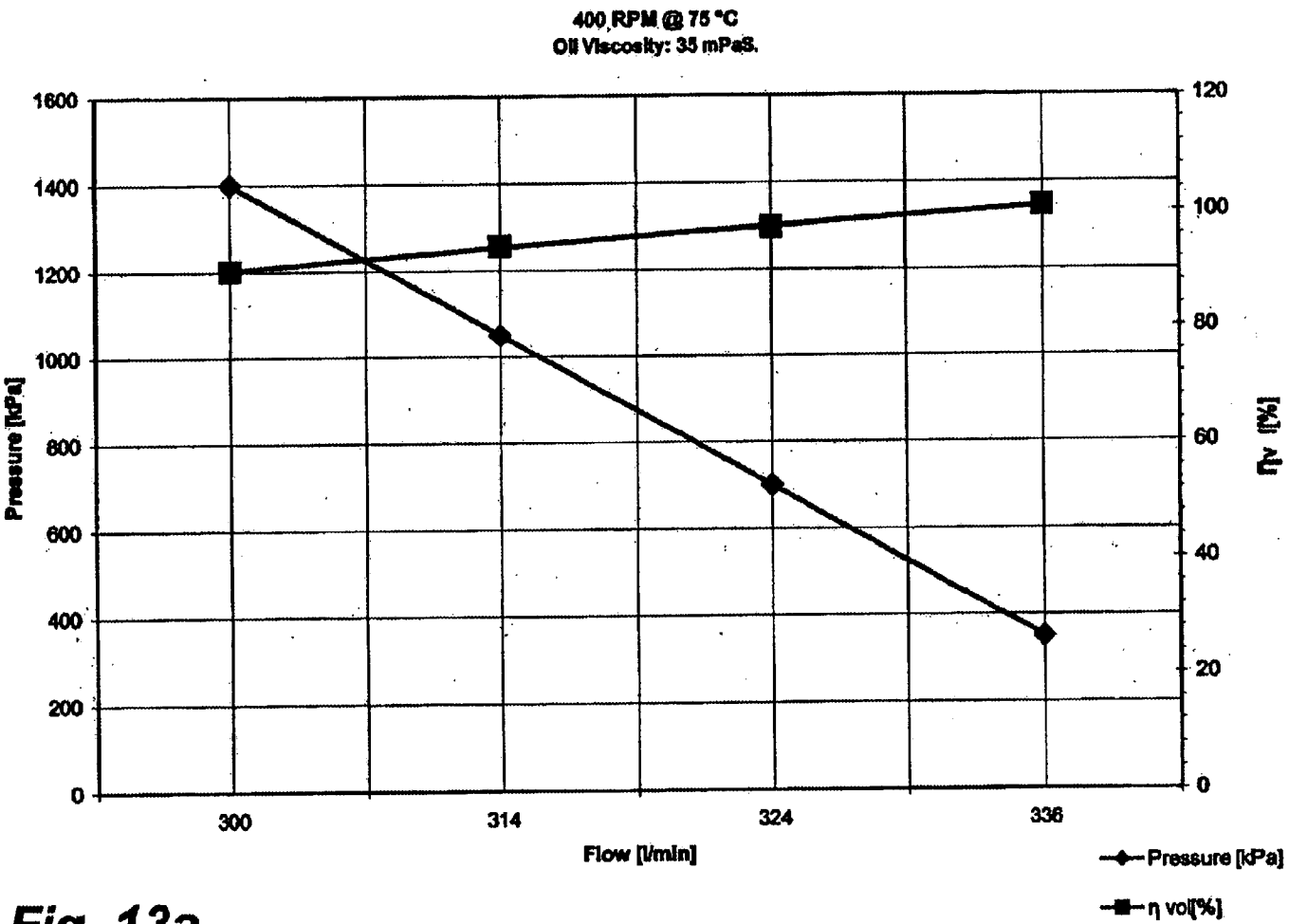
FIGS. 13*a*–13*c* are test results according to FIGS. 12*a*–12*c*, also depicting the efficiency, power and torque curves when pumping SAE30 oil at 70° C.
Figure 13B:
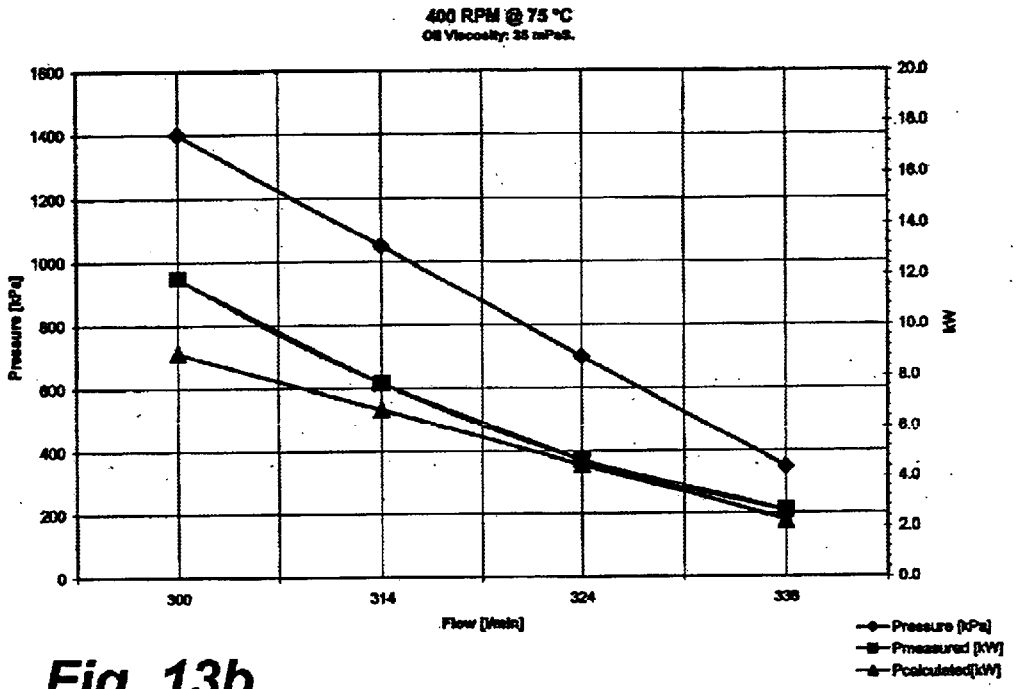
Figure 13C:
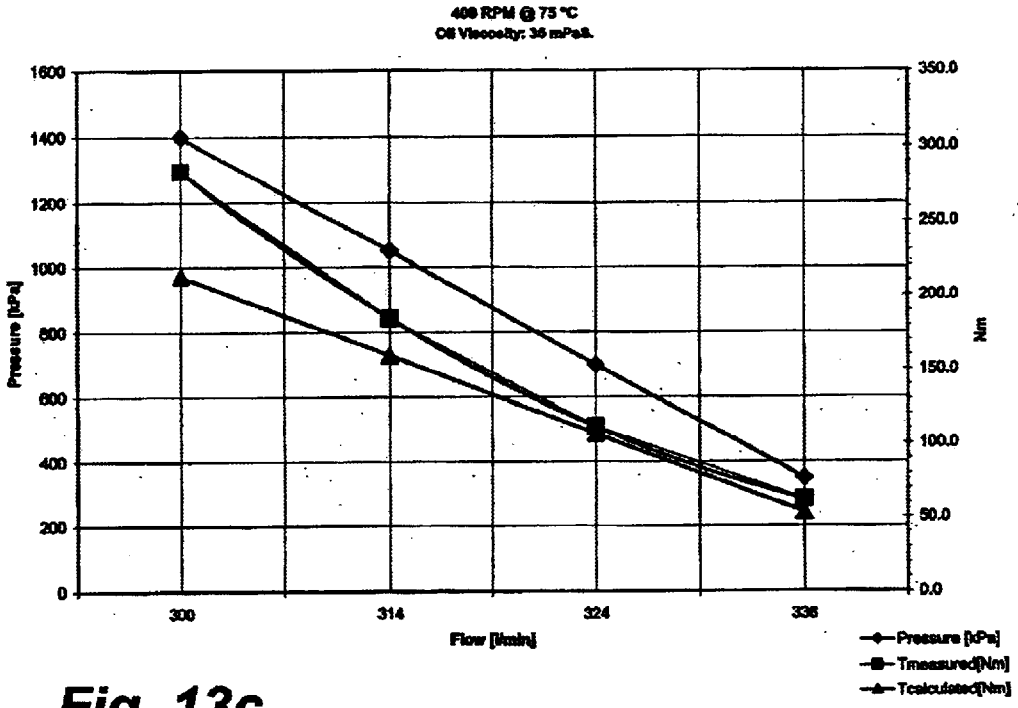
Figure 14A:
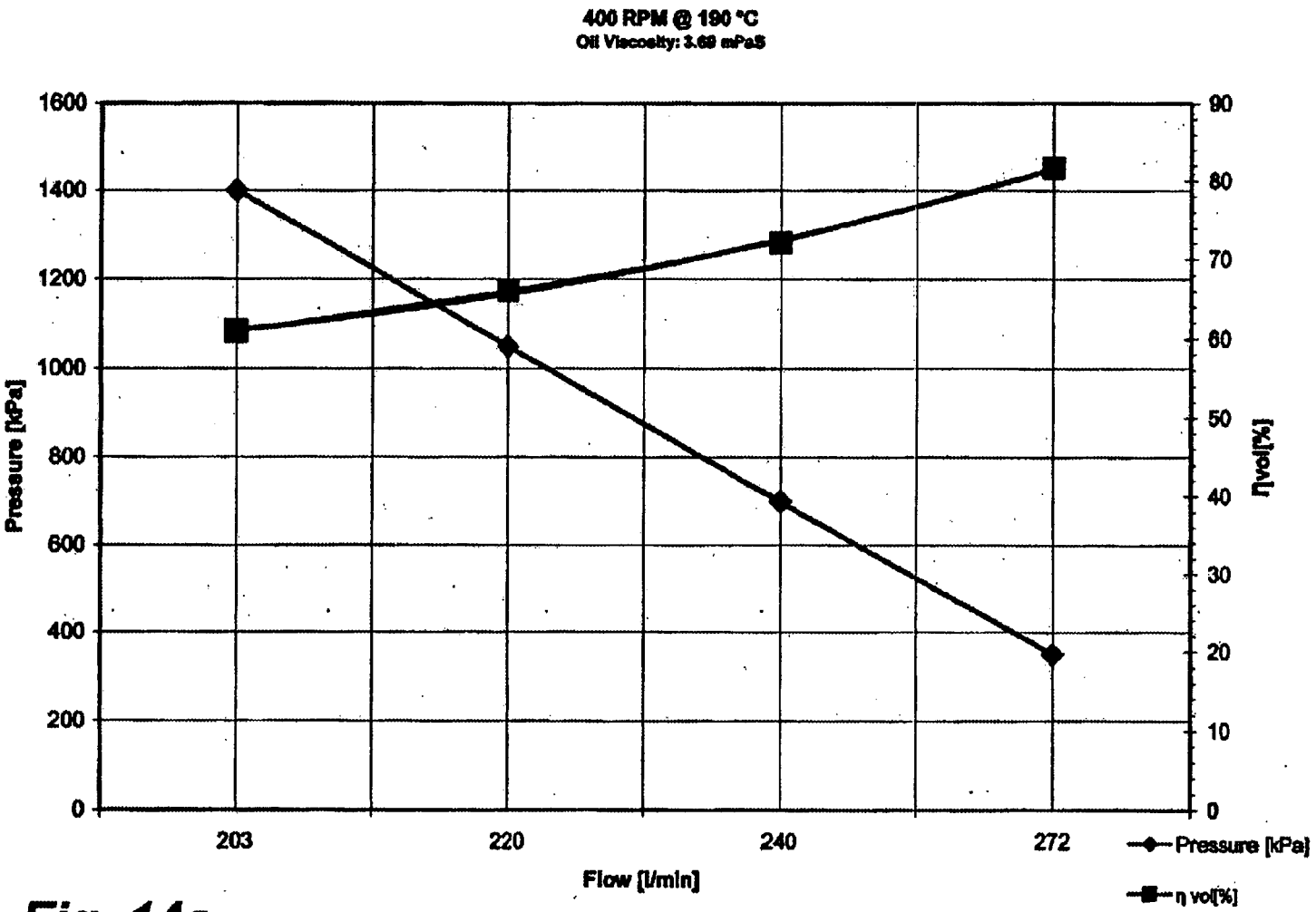
FIGS. 14*a*–14*c* are test results according to FIGS. 12*a*–12*c*, also depicting the efficiency, power and torque curves when pumping SAE30 oil at 190° C.
Figure 14B:
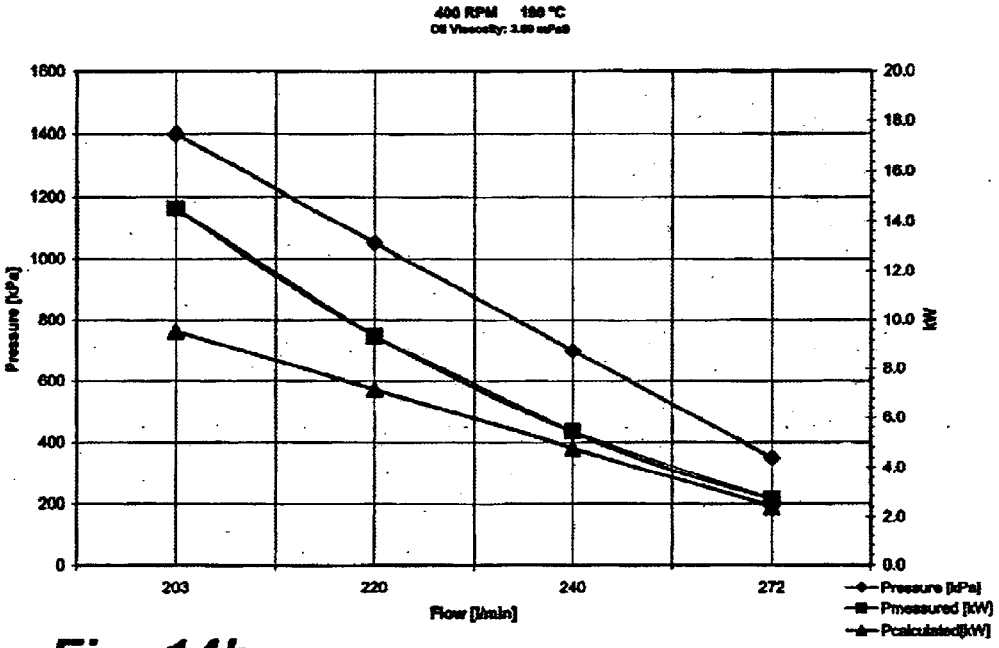
Figure 14C:
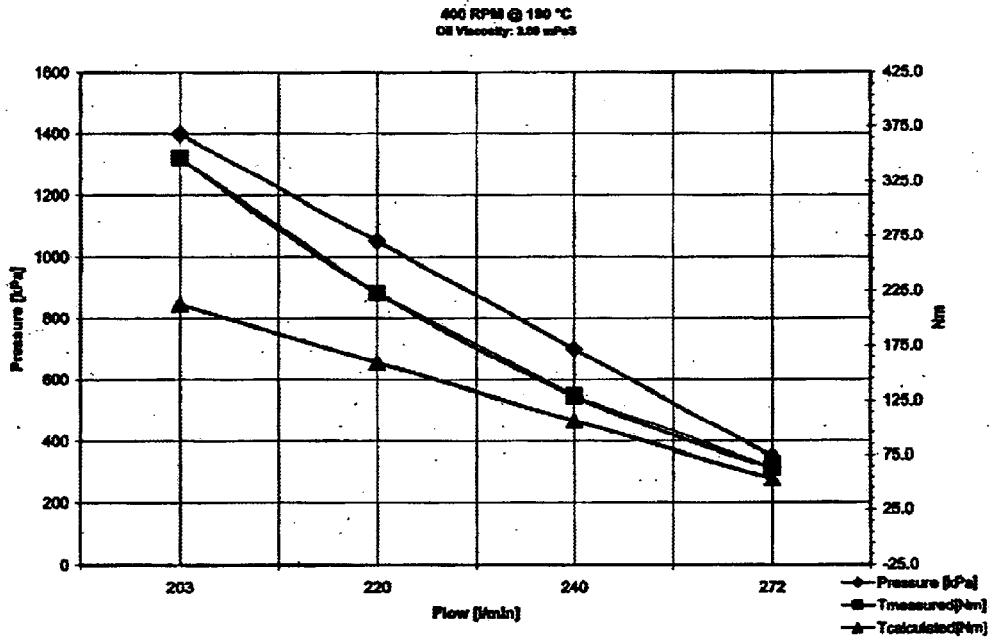

Having reference to FIGS. 12*a*–12*c*, a single stage 22 having five sections 21 of the above pump 20 was manufactured, assembled and operated on water at 30° C. The water had a viscosity of less than about 1 mPa·s. The figures are graphs of pump performance versus fluid discharge flow rates and discharge pressure. FIG. 12*a* demonstrates test results for pump efficiency pumping water at 30° C. FIGS. 12*b* and 12*c* illustrate the pump power and torque. FIGS. 13*a*–13*c* illustrate the same parameters of efficiency, power and torque curves when pumping SAE30 oil at 70° C. and FIGS. 14*a*–14*c* illustrated efficiency, power and torque curves when pumping SAE30 oil at 190° C.

With oil at 70° C., the 5 stages produced flow rates in the order of 340–300 l/min at between 350–1400 kPa respectively. Through extrapolation to 15 sections 21 per stage 22, one would expect to get about three times the flow rate or upwards of 1000 liters/min, and when pumped through two additional pressure stages, each having 15 sections for maintaining the flow rates, one could expect discharge pressures of up to about 4200 kPa.

The embodiments of the invention in which an exclusive property or privilege is claimed are defined as follows:

1. A multi-chamber positive displacement fluid device comprising:

a suction stage having one or more axially stacked positive displacement suction sections, each suction section having a rotor chamber for pumping fluid from an inlet adapted for connection to a fluid source to a discharge manifold;

at least one pressure stage, arranged axially with the suction stage, each pressure stage having one or more axially stacked positive displacement pressure sections, each pressure section having a rotor chamber for pumping fluid from a suction manifold to a discharge manifold adapted for connection to a fluid destination;

a cross-over section sandwiched axially between the suction stage and each successive pressure stage, the cross-over section having passage for fluid connection of each stage's discharge manifold to the suction manifold of each successive pressure stage;

a pair of parallel and contra-rotating rotors operable in the rotor chamber of each section for displacing fluid from each chambers' inlet to its respective discharge when rotated, the pair of rotors for each section being aligned axially with the pair of rotors for each other section;

a drive shaft extending axially and rotatably into each chamber of the at least one suction stage and the at least one pressure stage for rotating one rotor of the pair of rotors in each section;

an idler shaft parallel to the drive shaft and extending axially and rotatably into each chamber of the at least one suction stage and the at least one pressure stage for the other rotor of the pair of rotors; and timing means between the drive shaft and idler shaft for contra-rotating the drive and idler shafts and the pair of rotors.

2. The positive displacement fluid device of claim 1 wherein fluid is driven from the fluid source to the fluid destination for fluidly driving the pair of rotors so as to motor the drive shaft.

3. The positive displacement fluid device of claim 1 wherein the fluid device is a pump and the chambers are rotor chambers and wherein the drive shaft is driven for contra-rotating the pair of rotors so as to cause fluid to be pumped through the rotor chambers from the fluid source to the fluid destination.

4. The positive displacement pump of claim 3 wherein each of the pair of rotors comprises a circumferential piston, further comprising:

a pair of bosses extending into each rotor chamber, each boss having a cylindrical bore for rotatably passing the drive and idler shafts; and bearings fit into the bore of each boss for rotatably supporting the drive and idler shafts.

5. The positive displacement pump of claim 4 wherein the bearings are complementary facing hard bearing surfaces in the boss and on the drive and idler shafts.

6. The positive displacement pump of claim 5 wherein the complementary facing hard bearing surfaces are manufactured from material selected from the group consisting of tungsten carbide, silicon carbide and ceramics.

7. The positive displacement fluid device of claim 4 wherein as the drive shaft rotates, the first and second rotors of each pumping section rotate and each pumping section discharges fluid pulses according to the angular position of the rotors and wherein the first rotor of two or more of the pumping sections are angularly incremented on the drive shaft so that discharge pulses from the two or more pumping sections occur at different angular positions of the drive shaft.

8. The positive displacement fluid device of claim 7 wherein each pump section further comprises:

a pump housing forming a rotor chamber and a discharge chamber;

first and second end plates for enclosing the rotor chamber and at least one of the end plates between adjacent pump housings having a discharge chamber which is in communication with the discharge chamber of the pump housing for forming a discharge manifold; and first and second cooperating rotors operable in the rotor chamber to displace fluid from the inlet to the discharge chamber of the pump housing and to discharge manifold.

9. The positive displacement device of claim 8 further comprising:

a drive shaft extending through at least one end plate for rotating one rotor;

an idler shaft extending through the at least one end plate which is driven by the drive shaft for rotating the other rotor; and timing means between the drive shaft and idler shaft for contra-rotating the first and second rotors so that they cooperate to pump fluid.

10. The positive displacement fluid device of claim 9 wherein the rotors are first and second circumferential pistons mounted for co-rotation with the drive shaft and idler shaft, further comprising:

first and second bosses extending from an end plate, the first and second rotors being positioned in the rotor chamber and about the first and second bosses for pumping fluid through the rotor chamber; and bearings rotatably supporting the drive and idler shafts in the bosses.

11. The positive displacement fluid device of claim 10 wherein the bearings are complementary facing hard bearing surfaces.

12. The positive displacement fluid device of claim 11 wherein the complementary facing hard bearing surfaces are manufactured from material selected from the group consisting of tungsten carbide, silicon carbide and ceramics.

13. The positive displacement fluid device of claim 12 further comprising a cross-over section between the discharge of the at least one suction pump section and the inlet of the at least one pressure pump section.

14. The positive displacement fluid device of claim 13 wherein the seals comprise high temperature O-ring seals.

15. The positive displacement fluid device of claim 3 wherein two or more pressure stages are stacked successively together, further comprising a cross-over section sandwiched between each successive stage, the cross-over section having a passage for fluid connection between one pressure stage's discharge manifold and the successive pressure stage's suction manifold.

16. The positive displacement fluid device of claim 15 further comprising:

a tubular housing having a wall and a bore, the one or more suction stages, one or more crossover sections and one or more pressure stages being sandwiched sealingly together and housed within the bore, the housing being adapted for immersion in the fluid source;

inlet ports formed in the wall corresponding to and in fluid communication with each of the inlets of the at least one suction section; and a discharge port in fluid communication with the discharge of the pressure stage and with the fluid destination.

17. The positive displacement fluid device of claim 15 further comprising:

a tubular housing having a wall and a bore, the one or more suction stages, one or more crossover sections and one or more pressure stages being sandwiched sealingly together and housed within the bore, the housing being adapted for immersion in the fluid source;

a suction manifold which fluidly connects the inlets of the suction sections in the suction stage;

an inlet port in fluid communication with the suction manifold of the suction stage; and a discharge port in fluid communication with the discharge of the pressure stage and with the fluid destination.

18. The positive displacement fluid device of claim 1 further comprising seals sandwiched between each suction section, each crossover section and each pressure section.

19. A multi-stage positive displacement pump comprising:

a suction stage having one or more axially stacked positive displacement suction pump sections, each suction pump section having a rotor chamber for pumping fluid from an inlet adapted for connection to a fluid source to a discharge manifold;

at least one pressure stage, arranged axially with the suction stage, each pressure stage having one or more stacked positive displacement pressure pump sections, each pressure pump section having a rotor chamber for pumping fluid from a suction manifold to a discharge manifold adapted for connection to a fluid destination;

a crossover section sandwiched axially between the suction stage and the at least one pressure stage, for fluidly connecting the discharge manifold of the suction stage to the suction manifold of the pressure stage; and a drive shaft extending axially into each suction pump section and into each pressure pump section which rotates for moving fluid from the fluid source to the fluid destination.

20. The positive displacement fluid device of claim 19 further comprising:

a tubular housing having a wall and a bore, the suction stage, cross-over section and pressure stage being sandwiched sealingly together and housed within the bore, the housing being adapted for immersion in the fluid source;

an inlet port formed in the wall of the housing and corresponding to each pump section, the inlet ports being in fluid communication with each pump section inlet; and a discharge port formed in the housing and in fluid communication with the discharge of the pressure stage and with the fluid destination.

21. The positive displacement fluid device of claim 19 further comprising:

a pair of cooperating rotors operable in the rotor chamber of each section for displacing fluid from the inlet to the discharge when rotated; and wherein the drive means comprises:

a drive shaft extending axially and rotatably into the chamber of each section for rotating the first rotors of each section, an idler shaft extending axially and rotatably Into each rotor chamber for rotating the second rotors of each pumping section, and timing means between the drive shaft and idler shaft for contra-rotating each of the rotors.

22. The positive displacement fluid device of claim 19 further comprising:

a tubular housing having a wall and a bore, the one or more suction stages, one or more cross-over sections and one or more pressure stages being sandwiched sealingly together and housed within the bore, the housing being adapted for immersion in the fluid source, a suction manifold which fluidly connects the inlets of the suction sections in the suction stage;

an inlet port in fluid communication with the suction manifold of the suction stage; and a discharge port in fluid communication with the discharge of the pressure stage and with the fluid destination.

23. A method of pumping fluid comprising the steps of:

providing two or more positive displacement pump sections, each section having a pair of parallel and contra-rotating rotors operable in a rotor chamber of each section for displacing fluid from each rotor chambers' inlet to a respective discharge when rotated, the pair of rotors for each section being aligned axially with the pair of motors for each other section;

forming a suction stage by axially stacking one or more pump sections within the suction stage so that respective axes of the rotors align and the discharges form a contiguous discharge manifold;

forming at least one pressure stage by axially stacking one or more pump sections within the pressure stage so that the respective axes of the rotors align, the inlets forming a contiguous suction manifold and the discharges forming a contiguous discharge manifold;

stacking the suction stage and the one or more pressure stages axially and aligning the respective axes of the rotors;

sandwiching cross-over sections axially between the suction stage and each successive pressure stage, each cross-over section having a passage for fluid connection of each stage's discharge manifold to the suction manifold of each successive pressure stage; and driving the rotors of each pump section with a timed drive shaft and cooperating idler shaft each of which extend axially and drivably through the axis of each rotor of each pump section, the driveshaft extending axially through the suction stage and each successive pressure stage to draw fluid through the inlets and discharge the fluid through the discharge manifold.

* * * * *